US012570905B2

(12) United States Patent
Smith et al.

(10) Patent No.: US 12,570,905 B2
(45) Date of Patent: Mar. 10, 2026

(54) STEAM CRACKING PROCESS FOR CONVERTING CRUDE OILS TO PITCH COMPOSITIONS SPINNABLE INTO CARBON ARTICLES

(71) Applicant: ExxonMobil Technology and Engineering Company, Annandale, NJ (US)

(72) Inventors: Stuart E. Smith, Easton, PA (US); Clarence E. Chase, Bensalem, PA (US); Kazem V. Edmond, Lebanon, NJ (US); Manesh Gopinadhan, Basking Ridge, NJ (US); David T. Ferrughelli, Easton, PA (US)

(73) Assignee: ExxonMobil Technology and Engineering Company, Spring, TX (US)

( * ) Notice: Subject to any disclaimer, the term of this patent is extended or adjusted under 35 U.S.C. 154(b) by 298 days.

(21) Appl. No.: 18/251,676

(22) PCT Filed: Nov. 10, 2021

(86) PCT No.: PCT/US2021/072317
§ 371 (c)(1),
(2) Date: May 3, 2023

(87) PCT Pub. No.: WO2022/150232
PCT Pub. Date: Jul. 14, 2022

(65) Prior Publication Data

US 2024/0018418 A1 Jan. 18, 2024

Related U.S. Application Data

(60) Provisional application No. 63/134,198, filed on Jan. 6, 2021.

(51) Int. Cl.
*C10C 3/00* (2006.01)
*C10C 3/02* (2006.01)
(Continued)

(52) U.S. Cl.
CPC ..... *C10C 3/002* (2013.01); *C10C 3/02* (2013.01); *C10C 3/08* (2013.01); *C10G 9/36* (2013.01);
(Continued)

(58) Field of Classification Search
CPC .. C10C 3/002; C10C 3/02; C10C 3/08; C10G 9/36; C10G 67/0454; C10G 69/06;
(Continued)

(56) References Cited

U.S. PATENT DOCUMENTS 3,976,729 A 8/1976 Lewis et al.
4,086,156 A 4/1978 Dickakian
(Continued)

FOREIGN PATENT DOCUMENTS

EP 0090475 A1 * 10/1983 ..... D01F 9/145
JP S57168990 A 10/1982
(Continued)

OTHER PUBLICATIONS

Ilavsky et al., Journal of Applied Crystallography, vol. 42, pp. 347-353, 2009.
(Continued)

*Primary Examiner* — Prem C Singh
*Assistant Examiner* — Juan C Valencia
(74) *Attorney, Agent, or Firm* — C. Tumey Law Group PLLC

(57) ABSTRACT

Pitch compositions may be obtained by subjecting one or more crude oils to steam cracking. Processes for producing pitch compositions suitable for spinning into fibers from steam cracking of crude oils may comprise: steam cracking
(Continued)

of one or more crude oils in a steam cracking zone to produce a first effluent comprising a heavy oil mixture comprising a steam cracker tar, a second effluent comprising a mixture of gaseous products and liquid products, and a third effluent comprising one or more bottoms products; pretreating and heat treating the first, second and/or third effluent to produce a pitch composition having a mesophase content from 0 vol % to 100 vol %, based on the total volume of the pitch product, an MCR in the range of about 40 wt % to about 95 wt %, and a softening point $T_{sp}$ in the range of about 50° C. to about 400° C.

23 Claims, 5 Drawing Sheets

(51) Int. Cl.

| | |
|---|---|
| ***C10C 3/08*** | (2006.01) |
| ***C10G 9/36*** | (2006.01) |
| ***C10G 67/04*** | (2006.01) |
| ***C10G 69/06*** | (2006.01) |
| ***D01F 9/155*** | (2006.01) |

(52) U.S. Cl.
CPC ..... *C10G 67/0454* (2013.01); *C10G 69/06* (2013.01); *D01F 9/155* (2013.01); *C10G 2300/202* (2013.01)

(58) Field of Classification Search
CPC ..... C10G 2300/202; C10G 51/023; C10G 55/04; D01F 9/155
See application file for complete search history.

(56) References Cited

U.S. PATENT DOCUMENTS

| | | | | |
|---|---|---|---|---|
| 4,208,267 | A | 6/1980 | Diefendorf et al. | |
| 4,240,898 | A | 12/1980 | Gom | |
| 4,663,021 | A * | 5/1987 | Arai ..... | C10G 51/023 208/67 |
| 7,138,047 | B2 | 11/2006 | Stell et al. | |
| 7,820,035 | B2 | 10/2010 | McCoy et al. | |
| 8,684,384 | B2 | 4/2014 | Spicer et al. | |
| 2009/0050530 | A1 | 2/2009 | Spicer et al. | |

FOREIGN PATENT DOCUMENTS

| | | |
|---|---|---|
| JP | S5874786 | 5/1983 |
| KR | 20180045953 | 5/2018 |
| WO | 2015/167774 A2 | 11/2015 |
| WO | 2019/014010 | 1/2019 |
| WO | 2020115659 | 6/2020 |

OTHER PUBLICATIONS

Ilavsky, Journal of Applied Crystallography, vol. 45, pp. 324-328, 2012.

Cavette, Chris. "How carbon fiber is made—material, making, used, processing, parts, components, composition, Structure." www.MadeHow.com accessed via web.archive.org website, https://web.archive.org/web/20201209090559/http://www.madehow.com/Volume-4/Carbon-Fiber.html. Accessed Nov. 22, 2024.

International Search Report and Written Opinion for International Patent Application No. PCT/US2021/072317 dated Feb. 28, 2022.

Chinese Office Action for CN Patent Application No. 202180080250.9 dated Mar. 26, 2024. English Machine Translation with Original Untranslated Version, PDF file. 19 pages.

* cited by examiner

STEAM CRACKING PROCESS FOR CONVERTING CRUDE OILS TO PITCH COMPOSITIONS SPINNABLE INTO CARBON ARTICLES

FIELD OF THE INVENTION

The present disclosure relates to processes for producing pitch compositions from steam cracking of crude oils, and pitch compositions suitable for spinning into fibers.

BACKGROUND OF THE INVENTION

The carbon fiber industry has been growing steadily to meet the demand from a wide range of industries such as automotive (e.g., body parts such as deck lids, hoods, front end, bumpers, doors, chassis, suspension systems such as leaf springs, drive shafts), aerospace (such as aircraft and space systems), high performance aquatic vessels (such as yachts and rowing shells), airplanes, sports equipment (e.g., golf club, tennis racket, bikes, ski boards, snowboards, helmets, rowing or water skiing equipment), construction (non-structural and structural systems), military (e.g., flying drones, armor, armored vehicles, military aircraft), wind energy industries, energy storage applications, fireproof materials, carbon-carbon composites, carbon fibers, and in many insulating and sealing materials used in construction and road building (e.g., concrete), turbine blades, light weight cylinders and pressure vessels, off-shore tethers and drilling risers, medical, for example. The non-limiting foregoing properties of the carbon fibers make such material suitable for high-performance applications: high bulk modulus and tensile modulus (depending on the morphology of the carbon fiber), high electrical and thermal conductivities, high specific strength, etc. However, the high cost of carbon fiber and carbon fiber composites limits its applications and widespread use, in spite of the remarkable properties exhibited by such material. Hence, developing low-cost technologies has been a major challenge for researchers and key manufacturers.

Pitch-based carbon fibers are typically produced from coal tar, or petroleum pitch. However, the majority of carbon fibers are produced from polyacrylonitrile (PAN). Petroleum pitch-based carbon fibers suffers from batch dependencies due to feed variability, and process changes, resulting in a lack of widespread, and reliable commercial supply of isotropic and/or mesophase pitch. Historically, isotropic petroleum pitch used in carbon fiber production was sourced primarily from a single refinery (such as Ashland Petroleum Company).

SUMMARY OF THE INVENTION

In at least one embodiment, the present disclosure provides processes for producing pitch compositions from steam cracking of crude oils, and pitch compositions suitable for spinning into fibers. The processes comprise: steam cracking of one or more crude oils in a steam cracking zone to produce a first effluent comprising a heavy oil mixture comprising a steam cracker tar, a second effluent comprising a mixture of gaseous products and liquid products, and a third effluent comprising one or more bottoms products; optionally introducing at least a portion of the first effluent from downstream of the steam cracking zone and/or at least a portion of the second effluent from downstream of the steam cracking zone and/or at least a portion of the third effluent from downstream of the steam cracking zone to one or more pretreating zones to produce a first effluent pretreated product and/or a second effluent pretreated product and/or a third effluent pretreated product; introducing the first effluent, the first effluent pretreated product, the second effluent, the second effluent pretreated product, the third effluent, the third effluent pretreated product, or any combination thereof, to a reaction zone; and heat treating the first effluent, the first effluent pretreated product, the second effluent, the second effluent pretreated product, the third effluent, the third effluent pretreated product, or any combination thereof, in the reaction zone to a temperature in the range of about 200° C. to about 800° C. to produce a first reaction effluent comprising a pitch product, and a second reaction effluent comprising a mixture of gaseous and liquid products, wherein the pitch product has a mesophase content from 0 vol % to 100 vol %, based on the total volume of the pitch product, an MCR in the range of about 40 wt % to about 95 wt %, and a softening point $T_{sp}$ in the range of about 50° C. to about 400° C.

In at least one embodiment, the present disclosure provides processes for producing pitch compositions from steam cracking of crude oils, and pitch compositions suitable for spinning into fibers. The processes comprise: steam cracking of one or more crude oils in a steam cracking zone to produce a first effluent comprising a heavy oil mixture comprising a steam cracker tar, a second effluent comprising a mixture of gaseous products and liquid products, and a third effluent comprising one or more bottoms products, wherein the first effluent is sent directly to the reaction zone for heat treatment and the first reaction effluent and/or the second reaction effluent are/is sent to a separation zone to produce at least one pitch product and a separated reaction effluent comprised of gaseous and liquid hydrocarbons; introducing the first effluent, the first effluent pretreated product, the second effluent, the second effluent pretreated product, the third effluent, the third effluent pretreated product, or any combination thereof, to a reaction zone; and heat treating the first effluent, the first effluent pretreated product, the second effluent, the second effluent pretreated product, the third effluent, the third effluent pretreated product, or any combination thereof, in the reaction zone to a temperature in the range of about 200° C. to about 800° C. to produce a first reaction effluent comprising a pitch product, and a second reaction effluent comprising a mixture of gaseous and liquid products, wherein the pitch product has a mesophase content from 0 vol % to 100 vol %, based on the total volume of the pitch product, an MCR in the range of about 40 wt % to about 95 wt %, and a softening point $T_{sp}$ in the range of about 50° C. to about 400° C.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, as will occur to one having ordinary skill in the art and having the benefit of this disclosure.

DETAILED DESCRIPTION OF THE INVENTION

Figure 1:
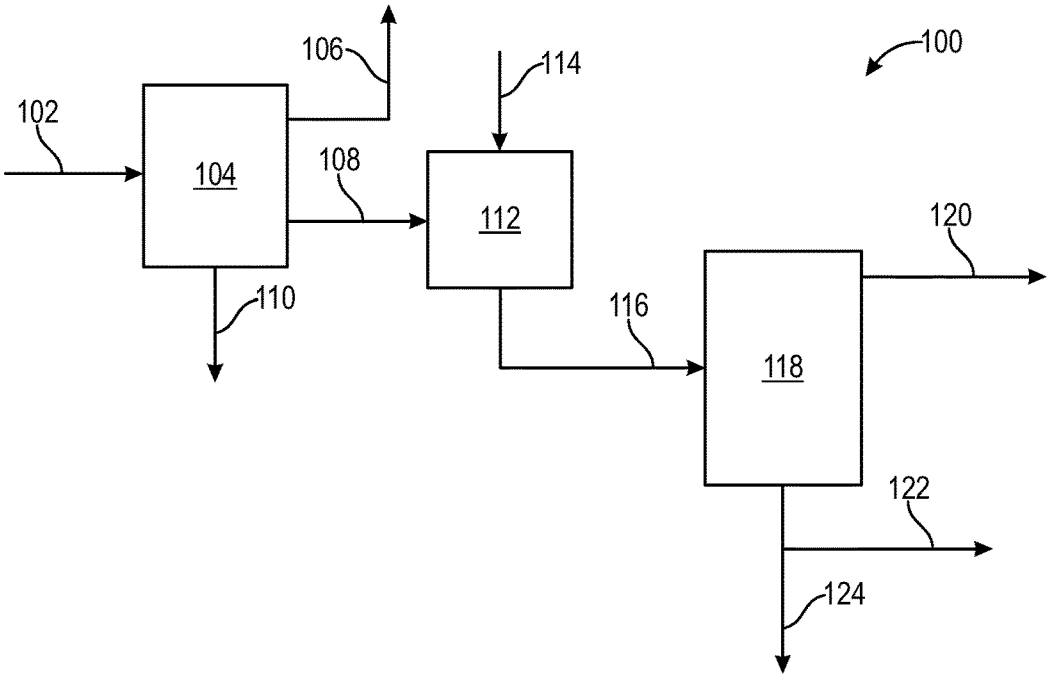
FIG. 1 is a non-limiting example flow diagram of a method 100 for producing spinnable pitches from steam cracked crude oils of the present disclosure.

The present disclosure relates to processes for producing pitch compositions from steam cracking of crude oils, pitch compositions suitable for spinning into fibers, and methods for characterizing the pitch compositions.

Generally, the methods described herein relate to the steam cracking of crude oils for the production of isotropic pitch compositions, and/or mesophase pitch compositions, and further for the production of fibers, fibrous webs, carbon composites and carbon articles.

Further, methods of the present disclosure advantageously produce cost-effective pitches suitable for spinning into fibers, fibrous webs, carbon fibers, carbon fiber composites and carbon articles derived from the steam cracking of crude oils. Advantageously, methods of the present disclosure enable significant feed flexibility, and the ability to produce pitch at scales never previously accomplished.

Definitions and Test Methods

The new notation for the Periodic Table Groups is used as described in Chemical and Engineering News, 63(5), 27 (1985).

The following abbreviations are used herein: DSC is differential scanning calorimetry; TGA is thermal gravimetric analysis; $T_g$ is glass transition temperature, $T_{sp}$ is softening point temperature; QI is quinoline insoluble; PAH is polycyclic aromatic hydrocarbons; SCF/B is standard cubic feet of hydrogen per barrel of total feed; MCR is microcarbon residue; N is number of molecules; MCRT is microcarbon residue test; RPM is rotation per minute; Pa·s is Pascal-second; wt % is weight percent; mol % is mole percent; vol % is volume percent; hr is hour; psig is pounds per square in gauge; LHSV is liquid hourly space velocity; N/A is not applicable; N/D is not determined.

All numerical values within the detailed description and the claims herein are modified by "about" or "approximately" with respect to the indicated value, and take into account experimental error and variations that would be expected by a person having ordinary skill in the art. Unless otherwise indicated, ambient temperature (room temperature) is about 18° C. to about 20° C.

As used in the present disclosure and claims, the singular forms "a," "an," and "the" include plural forms unless the context clearly dictates otherwise.

The term "and/or" as used in a phrase such as "A and/or B" herein is intended to include "A and B," "A or B," "A," and "B."

Where the term "between" is used herein to refer to ranges, the term encompasses the endpoints of the range. That is, "between 2% and 10%" refers to 2%, 10% and all percentages between those terms.

The term "independently," when referenced to selection of multiple items from within a given Markush group, means that the selected choice for a first item does not necessarily influence the choice of any second or subsequent item. That is, independent selection of multiple items within a given Markush group means that the individual items may be the same or different from one another.

As used herein, the term "pitch" refers to hydrocarbons with softening points above 50° C., consisting of mainly aromatic and alkyl-substituted aromatic compounds. These aromatic compounds are primarily hydrocarbons, but heteroatoms and traces of metals can be present within these materials. When cooled from a melt, a pitch can solidify into an amorphous solid. Pitches may include petroleum pitches, coal tar pitches, natural asphalts, pitches contained as by-products in the naphtha cracking industry, pitches of high carbon content obtained from petroleum asphalt and other substances having properties of pitches produced as products in various industrial production processes. Pitches exhibit a broad softening temperature range and are typically derived from petroleum, coal tar, plants, or catalytic oligomerization of small molecules (e.g., acid-catalyzed oligomerization). A pitch can also be referred to as tar, bitumen, or asphalt. When a pitch is produced from plants, it is also referred to as resin. Various pitches may be obtained as products in the gas oil or naphtha cracking industry as a carbonaceous residue consisting of a complex mixture of primarily aromatic organic compounds, which are solids at room temperature, and exhibit a relatively broad softening temperature range. Hence, a pitch can be obtained from heat treatment and distillation of petroleum fractions. A "petroleum pitch" refers to the residuum carbonaceous material obtained from distillation of crude oils and from the catalytic cracking of petroleum distillates. A "coal tar pitch" refers to the material obtained by distillation of coal.

As used herein, the term "mesophase" refers to a discotic liquid crystalline material consisting of planar aromatic molecules with a broader molecular weight distribution. A "mesophase pitch" consists of "mesophase" and optionally an isotropic phase. The mesophase exhibits optical anisotropy (birefringence) when examined using a polarized light microscope. For example, a mesophase pitch can be a pitch containing more than about 10 vol % mesophase, based on the total volume of the pitch. A mesophase content of a pitch can be measured, according to ASTM D4616 (Standard Test Method for Microscopical Analysis by Reflected Light and Determination of Mesophase in a Pitch), from reflected polarized light microscopy images by imbedding various samples of the pitch in epoxy, followed by polishing the samples until they become highly reflective. A series of images can be recorded in order to quantify the anisotropic content.

The term "blend" as used herein refers to a mixture of two or more pitches. Blends may be produced by, for example, solution blending, melt mixing in a heated mixer, physically blending a pitch in its liquid state and a different pitch in its solid state, or physically blending the pitches in their solid forms. Suitable solvents for solution blending can include benzene, toluene, naphthalene, xylenes, pyridine, quinoline, aromatic cuts from refining, or chemicals processes such as decant oil, reformate, tar distillation cuts, and so on. Solution blending, solid state blending, and/or melt blending may occur at a temperature of about 20° C. to about 400° C.

As used herein, "thermoset matrix" refers to a synthetic polymer reinforcement typically transformed from a liquid state to a solid state through a non-reversible chemical change. A thermoset matrix may also include cement, concrete, ceramic, glasses, pitch, metal, or metal alloys. A thermoset matrix can be incorporated with resins such as polyesters, vinyl esters, epoxies, bismaleimides, cyanate esters, polyimides or phenolics. When cured by thermal and/or chemical (catalyst or promoter) or other means, the thermoset matrix become substantially infusible and insoluble. After cure, a thermoset matrix cannot be returned to its uncured state. Composites made with thermoset matrices are strong and have very good fatigue strength. Such composites can be extremely brittle and may have low impact-toughness making. For example, thermoset matrix can be used for high-heat applications and/or chemical resistance is needed.

As used herein, "thermoplastic matrix" refers to polymers that can be molded, melted, and remolded without altering its physical properties. In some cases, a thermoplastic matrix can be tougher and less brittle than thermosets, with very good impact resistance and damage tolerance. In some other cases, a thermoplastic matrix may be held below its glass transition temperature, thus may be glassy and very brittle. Since the matrix can be melted, the composite materials can be easier to repair and can be remolded and recycled easily. Thermoplastic matrix can be less dense than thermoset matrix, making them a viable alternative for weight critical applications.

As used herein, "tensile strength" means the amount of stress applied to a sample to break the sample. It can be expressed in Pascals or pounds per square inch (psi). ASTM D3379 can be used to determine tensile strength of articles produced using a polymer.

Numerical ranges used herein include the numbers recited in the range. For example, the numerical range "from 1 wt % to 10 wt %" includes 1 wt % and 10 wt % within the recited range and all points within the range.

As used herein, a "glass transition temperature" ($T_g$) refers to a mid-point of the temperature at which a continuous step change in heat capacity (or peak at the first derivative of heat flow) is recorded on the second heating scan of a differential scanning calorimeter (DSC) experiment at 10° C./min heating and cooling rate. For purposes of the disclosure herein, $T_g$ may be measured using thermal analysis TA INSTRUMENTS Q2000™, as indicated.

The "softening point" refers to a temperature or a range of temperatures at which a substance softens. Herein, the softening point is measured using a METTLER TOLEDO dropping point instrument, such as METTLER TOLEDO DP70, according to a procedure analogous to ASTM D3104.

The "microcarbon residue test", also referred to as "MCRT", is a standard test method for the determination of microcarbon residue (micro method). The microcarbon residue (MCR) value of the various petroleum materials serves as an approximation of the tendency of the material to form carbonaceous type deposits under degradation conditions similar to those used in the test method, and can be useful as a guide in manufacture of certain stocks. However, care needs to be exercised in interpreting the results. This test method covers the determination of the amount of carbon residue formed after evaporation and pyrolysis of petroleum materials under certain conditions and is intended to provide some indication of the relative coke forming tendency of such materials. Herein, the MCRT is measured according to the ASTM D4530-15 standard test method.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the embodiments of the present disclosure. At the very least, and not as an attempt to limit the application of the doctrine of equivalents to the scope of the claim, each numerical parameter should at least be construed in light of the number of reported significant digits and by applying ordinary rounding techniques.

One or more illustrative embodiments incorporating the present disclosure embodiments disclosed herein are presented herein. Not all features of a physical implementation are described or shown in this application for the sake of clarity. It is understood that in the development of a physical embodiment incorporating the embodiments of the present disclosure, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for those of ordinary skill in the art and having benefit of this disclosure.

While compositions and methods are described herein in terms of "comprising" or "having" various components or steps, the compositions and methods can also "consist essentially of" or "consist of" the various components and steps.

Various uses for the carbon fiber composites formed from the pitch compositions of the present disclosure are also discussed herein. Such a carbon fiber composite may be useful in numerous applications where weight reductions paired with strength and stiffness enhancements are desired. Said carbon fiber composite may also be useful in offshore drilling (e.g., offshore drilling for oil and gas production) to improve corrosion resistance, fatigue and heat resistance, production components including, but not limited to platforms, risers, tethers, anchors, drill stems or related equipment and systems. Additional product applications can include automotive (e.g., body parts such as deck lids, hoods, front end, bumpers, doors, chassis, suspension systems such as leaf springs, drive shafts), aerospace (aircraft and space systems), sports equipment (e.g., golf club, tennis racket, bikes, ski boards, snowboards, helmets, rowing or water skiing equipment), construction (non-structural and structural systems), military (e.g., flying drones, armor, armored vehicles, military aircraft), wind energy industries, energy storage applications, fireproof materials, carbon-carbon composites, carbon fibers, in many insulating and sealing materials used in construction and road building (e.g., concrete), turbine blades, light weight cylinders and pressure vessels, off-shore tethers and drilling risers, medical equipment, for example.

Processes and Compositions.

As discussed above, the present disclosure relates to processes for producing pitch compositions suitable for spinning into fibers, binder pitch, graphitizable carbon microbeads, solid lubricants, activated carbon fiber, battery anodes, and carbon foams.

The present disclosure provides a process comprising: steam cracking of one or more crude oils in a steam cracking zone to produce a first effluent comprising a heavy oil mixture comprising a steam cracker tar, a second effluent comprising a mixture of gaseous products and liquid products, and a third effluent comprising one or more bottoms products; optionally introducing at least a portion of the first effluent from downstream of the steam cracking zone and/or at least a portion of the second effluent from downstream of the steam cracking zone and/or at least a portion of the third effluent from downstream of the steam cracking zone to one or more pretreating zones to produce a first effluent pretreated product and/or a second effluent pretreated product and/or a third effluent pretreated product; introducing the first effluent, the first effluent pretreated product, the second effluent, the second effluent pretreated product, the third effluent, the third effluent pretreated product, or any combination thereof, to a reaction zone; heat treating the first effluent, the first effluent pretreated product, the second effluent, the second effluent pretreated product, the third effluent, the third effluent pretreated product, or any combination thereof, in the reaction zone to a temperature in the range of about 200° C. to about 800° C. to produce a first reaction effluent comprising a pitch product, and a second reaction effluent comprising a mixture of gaseous and liquid products, wherein the pitch product has a mesophase content from 0 vol % to 100 vol %, based on the total volume of the pitch product, an MCR in the range of about 40 wt % to about 95 wt %, and a softening point $T_{sp}$ in the range of about 50° C. to about 400° C.

FIG. 1 is a non-limiting example flow diagram of a method 100 for producing pitch compositions suitable for spinning into fibers, binder pitch, graphitizable carbon microbeads, solid lubricants, activated carbon fiber, battery anodes, and carbon foams, from steam cracking of crude oils, of the present disclosure. Generally, methods for producing pitch compositions according to the present disclosure may comprise: steam cracking of one or more crude oils 102 in a steam cracking zone to produce first effluent 108 comprising a heavy oil mixture comprising a steam cracker tar, second effluent 106 comprising a mixture of gaseous products and liquid products, and third effluent 110 comprising one or more bottoms products (e.g., vacuum residue); optionally introducing at least a portion of first effluent 108 from downstream of steam cracking zone 104 and/or at least a portion of second effluent 106 from downstream of steam cracking zone 104 to one or more pretreating zones 112 to produce first effluent pretreated product 116 and/or a second effluent pretreated product (not shown); introducing first effluent 108, first effluent pretreated product 116, second effluent 106, the second effluent pretreated product (not shown), or any combination thereof, to reaction zone 118; and heat treating first effluent 108, first effluent pretreated product 116, second effluent 106, the second effluent pretreated product (not shown), or any combination thereof, in reaction zone 118 to a temperature in the range of 200° C. to 800° C. to produce a first reaction effluent comprising pitch product 122, and second reaction effluent 120 comprising a mixture of gaseous and liquid products, wherein pitch product 122 has a mesophase content from 0 vol % to 100 vol %, based on the total volume of the pitch product 122, an MCR in the range of about 40 wt % to about 95 wt %, based on the total weight of the pitch product 122, and a softening point $T_{sp}$ in the range of about 50° C. to about 400° C. (such as the pitch product may have $T_{sp}$ of about 100° C. or greater, for example). In some instances, the pitch product may have a mesophase content of about 10 vol % or less, based on the total volume of the pitch product. In some other instances, the pitch product may have a mesophase content of about 10 vol % to 100 vol %, based on the total volume of the pitch product. Furthermore, the pitch product may have a quinoline insoluble (QI) content of about 60 wt % or less (or about 50 wt % or less, or about 40 wt % or less, or about 30 wt % or less, or about 20 wt % or less, or about 10 wt % or less).

The first effluent 108 may be sent directly to reaction zone 118 for heat treatment and the first reaction effluent comprising pitch product 122 and/or the second reaction effluent (not shown) may be sent to a separation zone to produce at least one pitch product and a separated reaction effluent comprised of gaseous and liquid hydrocarbons (not shown); and wherein the at least one pitch product has a mesophase content from 0 vol % to 100 vol %, based on the total volume of the at least one pitch product, an MCR in the range of about 40 wt % to about 95 wt %, based on the total weight of the at least one pitch product, and a softening point $T_{sp}$ in the range of about 50° C. to about 400° C. The at least one pitch product may be suitable for spinning into carbon fiber, binder pitch, graphitizable carbon microbeads, solid lubricants, activated carbon fiber, battery anodes, or carbon foams.

The one or more crude oils 102 may have a T50 in the range of from about 240° C. to about 440° C., an MCR of about 25 wt % or less, a sulfur content of about 5 wt % or less, based on the total weight of the one or more crude oils 102.

The one or more crude oils 102 may have a T10 in the range of from about 50° C. to about 350° C., a T90 in the range of from about 300° C. to about 700° C., a hydrogen content of about 20 wt % or less, a n-heptane asphaltenes content of about 15 wt % or less, based on the total weight of the one or more crude oils 102.

The first effluent 108 is a mixture of hydrocarbons comprising one or more aromatic components, with at least about 70 wt % of the mixture having a boiling point at atmospheric pressure that is greater than about 200° C., an MCR of about 5 wt % to about 55 wt %, a hydrogen content of about 4 wt % to about 10 wt %, a sulfur content of about 5 wt % or less, based on the total weight of the first effluent.

The methods of the present disclosure may further comprise: combining first effluent 108 with a fluxant agent (not shown) to produce a fluxed effluent. Suitable examples of fluxant agent may be selected from the group consisting of: reformate, steam cracker naphtha, steam cracked gas oil (SCGO), atmospheric gas oil (AGO), heavy atmospheric gas oil (HAGO), vacuum gas oil (VGO), heavy vacuum gas oil, coker naphtha, light coker gas oil, heavy coker gas oil, main column bottoms, light cycle oil, heavy diesel oil (HDO), and any combination thereof.

The first effluent 108 may comprise a pitch product having a mesophase content of about 10 vol % or less (or about 9 vol % or less, or about 8 vol % or less, or about 6 vol % or less, or about 5 vol % or less, or about 4.5 vol % or less, or about 4 vol % or less, or about 3.5 vol % or less, or about 3 vol % or less, or about 2.5 vol % or less, or about 2 vol % or less, or about 1.5 vol % or less, or about 1 vol % or less, or about 0.5 vol % or less, such as 0 vol % mesophase), based on the total volume of the pitch product.

The first effluent 108 may comprise a pitch product having an MCR of from about 20 wt % to about 99 wt %, such as from about 30 wt % to about 99 wt %, such as from about 40 wt % to about 99 wt %, such as from about 50 wt % to about 99 wt %, such as from about 50 wt % to about 95 wt %, such as from about 50 wt % to about 90 wt %, such as from about 50 wt % to about 85 wt %, and such as from about 50 wt % to about 80 wt %, based on the total weight of the pitch product.

The first effluent 108 may comprise a pitch product having a QI content of about 60 wt % or less, or about 50 wt % or less, or about 40 wt % or less, or about 30 wt % or less, or about 20 wt % or less, or about 10 wt % or less.

The first effluent 108 may comprise a pitch product suitable for spinning having a softening point $T_{sp}$ of less than about 400° C. (or about 350° C. or less, or about 300° C. or less, or about 250° C. or less, or about 200° C. or less, or about 150° C. or less, or about 100° C. or less), as determined according to a procedure analogous to the ASTM D 3104 test method, wherein the procedure can be carried out under nitrogen, at a 2° C./min ramp rate up to a temperature of 400° C. The first effluent 108 may comprise a pitch product having a softening point $T_{sp}$ of about 100° C. or greater (or about 150° C. or greater, or about 200° C. or greater, or about 250° C. or greater, or about 300° C. or greater, or about 350° C. or greater).

The first effluent 108 may comprise a pitch product having a glass transition temperature ($T_g$) of less than about 350° C. (or about 325° C. or less, or about 300° C. or less, or about 275° C. or less, or about 235° C. or less, or about 195° C. or less, or about 155° C. or less, or about 115° C. or less, or about 75° C. or less, or about 70° C. or less), as determined using the second heating scan of a differential scanning calorimetry (DSC) experiment at 10° C./min heating and cooling rate performed under inert atmosphere ($N_2$).

The reaction effluent 120 and/or 122 can be separated by distillation, deasphaltenation, chromatographic separation, membrane-filtration, or any combination thereof. For example, deasphaltenation may be carried out using a solvent selected from the group consisting of: ethane, propanes, butanes, pentanes, hexanes, heptanes, octanes, or any combinations thereof.

The one or more pretreating zones 112 can be one or more hydrotreating zones, wherein the at least a portion of the first effluent can be hydrotreated to produce first effluent pretreated product 116, and wherein first effluent pretreated product 116 is a hydrotreated first effluent product.

The methods of the present disclosure may further comprise: separating the first effluent pretreated product 116 to produce at least one distillable product, and one non-distillable product. The first effluent pretreated product 116 may be separated by distillation.

The methods of the present disclosure may further comprise: heat treating the non-distillable product to produce a reaction effluent; separating the reaction effluent to produce a heat treated pitch product and a separated reaction effluent, wherein the separated reaction effluent comprises gaseous and liquid hydrocarbons, and wherein the heat treated pitch product has a mesophase content from 0 vol % to 100 vol %, based on the total volume of the heat treated pitch product, an MCR in the range of about 40 wt % to about 95 wt %, and a softening point $T_{sp}$ in the range of about 50° C. to about 400° C. The reaction effluent can be separated by distillation, deasphaltenation, chromatographic separation, membrane-filtration, or any combination thereof.

The third effluent 110 comprising one or more bottoms products can be sent directly to reaction zone 118 for heat treatment to produce a heat treated reaction effluent. The methods of the present disclosure may further comprise: separating the heat treated reaction effluent in a separation zone to produce at least one pitch product, and a separated reaction effluent comprised of gaseous and liquid hydrocarbons, wherein the at least one pitch product has a mesophase content from 0 vol % to 100 vol %, based on the total volume of the at least one pitch product, an MCR in the range of about 40 wt % to about 95 wt %, and a softening point $T_{sp}$ in the range of about 50° C. to about 400° C.

The heat treated reaction effluent can be separated by distillation, deasphaltenation, chromatographic separation, membrane-filtration, or any combination thereof.

The third effluent 110 comprising one or more bottoms products may be sent to a first separation zone to produce at least a first separation product and a second separation product, wherein at least a portion of the first separation product, or at least a portion of the second separation product may be sent to a reaction zone to produce a reaction effluent. The methods of the present disclosure may further comprise: separating the reaction effluent produced from at least a portion of the first separation product, or at least a portion of the second separation product to a second separation zone to produce at least one pitch product, and a separated reaction effluent comprised of gaseous and liquid hydrocarbons, wherein the at least one pitch product has a mesophase content from 0 vol % to 100 vol %, based on the total volume of the at least one pitch product, an MCR in the range of about 40 wt % to about 95 wt %, and a softening point $T_{sp}$ in the range of about 50° C. to about 400° C.

The first and second separation zones may be independently selected from the group consisting of: distillation, deasphaltenation, chromatographic separation, membrane-filtration, or any combination thereof.

The reaction zone is a tubular, batch, semi-batch, or continuous stirred tank reactor, and is either a thermal, or catalytic process. Furthermore, the reaction zone may be a thermal process or catalytic process.

The first effluent 108 comprising the pitch product described above may be sent to one or more heat treating zones to produce a heat treated pitch product having an MCR and a $T_{sp}$ both greater than the MCR and the $T_{sp}$ of the first effluent 108, and wherein the pitch product and/or the heat treated pitch product are suitable for spinning into carbon fiber.

The heat treated pitch product may have one or more of: a mesophase content of about 50 vol % or greater (or about 55 vol % or greater, or about 60 vol % or greater, or about 65 vol % or greater, or about 70 vol % or greater, or about 75 vol % or greater, or about 80 vol % or greater, or about 85 vol % or greater, or about 90 vol % or greater), based on the total volume of the heat treated pitch product; a QI content of about 1 wt % or greater (or about 5 wt % or greater, or about 10 wt % or greater, or about 20 wt % or greater, or about 25 wt % or greater, or about 30 wt % or greater, or about 40 wt % or greater, or about 50 wt % or greater, or about 60 wt % or greater, or about 70 wt % or greater, or about 80 wt % or greater, or about 90 wt % or greater, or about 95 wt % or greater), based on the total weight of the heat treated pitch product; and a $T_{sp}$ of about 200° C. or greater (or about 225° C. or greater, or about 250° C. or greater, or about 275° C. or greater, or about 300° C. or greater, or about 325° C. or greater, or about 350° C. or greater).

The hydrotreatment of first effluent 108 in hydrotreating zone 112 may be carried out catalytically, thermally, or a combination thereof. Suitable hydrotreating conditions may comprise one or more of: a partial pressure of hydrogen of about 3,500 psig or less (or about 3,250 psig or less, or about 3,000 psig or less, or about 2,500 psig or less, or about 2,000 psig or less, or about 1,500 psig or less, or about 1,000 psig or less, or about 500 psig or less, or about 250 psig or less, or about 100 psig or less, or about 50 psig or less), a temperature in the range of about 200° C. to about 500° C. (or about 225° C. to about 490° C., or about 250° C. to about 480° C., or about 275° C. to about 470° C.), a pressure in the range of about 72 psig to about 3,000 psig (or about 600 psig to about 1,900 psig, or about 700 psig to about 1,800 psig, or about 800 psig to about 1,700 psig, or about 900 psig to about 1,600 psig, or about 1,000 psig to about 1,500 psig), a time residency of about 5 minutes or greater (or about 10 minutes or greater, or about 15 minutes or greater, or about 20 minutes or greater, or about 25 minutes or greater, or about 30 minutes or greater, or about 1 hour or greater, or about 2 hour or greater, or about 3 hour or greater, or about 4 hour or greater, or about 5 hour or greater, or about 6 hour or greater, or about 7 hour or greater, or about 8 hour or greater, or about 9 hour or greater, or about 10 hour or greater, and an LHSV in the range of about 0.1 $hr^{-1}$ to about 12 $hr^{-1}$ (or about 0.5 $hr^{-1}$ to about 10 $hr^{-1}$, or about 0.75 $hr^{-1}$ to about 8 $hr^{-1}$, or about 1 $hr^{-1}$ to about 6 $hr^{-1}$, or about 1 $hr^{-1}$ to about 4 $hr^{-1}$). The hydrotreating may be continuous, semi-batch, or a batch process.

During hydrotreatment, hydrogen stream 114 can be fed or injected into hydrotreating zone 112 in which a catalyst or a catalyst system can be added. Hydrogen, which may be contained in a hydrogen treat gas (not shown), may be provided to hydrotreating zone 112. Hydrotreating may be a continuous fixed-bed process. Treat gas, as referred to herein, can be either pure hydrogen or a hydrogen-containing gas, which is a gas stream containing hydrogen in an amount that is sufficient for the intended reaction(s), optionally including one or more other gasses (e.g., nitrogen and light hydrocarbons such as methane), and which will not adversely interfere with or affect either the reactions or the products. Impurities, such as $H_2S$ and $NH_3$ are undesirable and would typically be removed from the treat gas before it is conducted to hydrotreating zone 112. The treat gas stream introduced into hydrotreating zone 112 will preferably contain at least about 25 vol %, such as at least about 50 vol %, and more preferably at least about 75 vol % hydrogen.

Hydrogen can be supplied at a rate of about 100 SCF/B to about 20,000 SCF/B (or about 500 SCF/B to about 15,000 SCF/B, or about 750 SCF/B to about 10,000 SCF/B, or about 1,000 SCF/B to about 8,000 SCF/B, or about 1,500 SCF/B to about 6,000 SCF/B, or about 2,000 SCF/B to about 5,000 SCF/B).

Hydrogen can be supplied co-currently with the first effluent 108 and/or solvent or separately via a separate gas conduit (not shown) to the hydrotreating zone 112. Particularly, when hydrotreating is catalytic, the contact of the first effluent 108, the solvent, the catalyst and the hydrogen may produce a total product that may include a hydrotreated product effluent 116, and, in some embodiments, gas. Catalytically hydrotreating first effluent 108 will be further described below.

Total pressure in the hydrotreating zone 112 can range from about 72 psig to about psig, such as from about 400 psig to about 4,000 psig, or from about 500 psig to about 2,000 psig, or from about 600 psig to about 1,500 psig. Preferably, first effluent 108 can be hydrotreated under low hydrogen partial pressure conditions. In such aspects, the hydrogen partial pressure during hydrotreatment can be about 100 psig to about 1,500 psig, such as from about 150 psig to about 1,000 psig, such as from about 200 psig to about 800 psig. Additionally or alternately, the hydrogen partial pressure can be at least about 200 psig, or at least about 400 psig, or at least about 600 psig. Additionally or alternately, the hydrogen partial pressure can be about 1,000 psig or less, such as about 900 psig or less, or about 850 psig or less, or about 800 psig or less, or about 750 psig or less. In such aspects with low hydrogen partial pressure, the total pressure in the hydrotreating zone 112 can be about 1,200 psig or less, and preferably about 1,000 psig or less, such as about 900 psig or less, or about 800 psig or less, or about 700 psig or less, or about 600 psig or less, or about 500 psig or less, or about 400 psig or less, or about 300 psig or less, or about 200 psig or less, or about 100 psig or less.

Liquid hourly space velocity (LHSV) of the first effluent 108, optionally combined with recycle components (not shown) may range from about 0.1 $h^{-1}$ to about 50 $h^{-1}$, or about 0.5 $h^{-1}$ to about 25 $h^{-1}$, or about 0.75 $h^{-1}$ to about 101 $h^{-1}$. In some aspects, LHSV is at least about 20 $h^{-1}$, or at least about 15 $h^{-1}$, or at least about 10 $h^{-1}$, or at least about 5 $h^{-1}$, or at least about 2 $h^{-1}$. Alternatively, in some aspects LHSV is about 5 $h^{-1}$ or less, or about 4 $h^{-1}$ or less, or about 3 $h^{-1}$ or less, or about 21 $h^{-1}$ or less, or about 1 $h^{-1}$ or less.

In some cases, hydrotreating may be performed catalytically using a catalyst system comprising: one or more transition metal catalysts comprising a group 5, 6, 9, 10 transition metal; and one or more supports.

The one or more transition metal catalysts may comprise a transition metal selected from the group consisting of: V, Mo, W, Co, Ni, Pt, Pd, or any combination thereof.

The one or more supports may be selected from the group consisting of: alumina, silica, silica-alumina, porous carbons, zeolites, zirconia, titania, and refractory oxides.

Hydrotreating may be carried out in presence of a hydrogen-donor solvent. The hydrogen-donor solvent may contain at least one single-ring aromatic compound.

The effluent of bottoms product 122 may have a T10 in the range of about 500° C. to about 600° C. (or about 510° C. to about 590° C., or about 520° C. to about 580° C., or about 530° C. to about 570° C., or about 540° C. to about 560° C.).

Hydrotreated product effluent 116 may have a T50 in the range of about 225° C. to about 375° C., a hydrogen content of about 7 wt % to about 12 wt %, a sulfur content of from 0 wt % to about 1 wt %, based on the total weight of the hydrotreated product effluent 116.

Hydrotreated product effluent 116 may have a T50 in the range of about 225° C. to about 375° C., a hydrogen content of about 7 wt % to about 12 wt %, a sulfur content of from 0 wt % to about 1 wt %, based on the total weight of the hydrotreated product effluent.

First reaction effluent comprising pitch product 122 may comprise bottoms products, which can be separated by deasphaltenation in the presence of a solvent to produce a first portion comprising solvent and soluble compounds, and a second portion comprising solvent and a deasphalted bottom product. The deasphalted bottom product may comprise a third pitch product having a softening point $T_{sp}$ of about 25° C. or greater, a hydrogen content of about 4 wt % to about 12 wt %, based on the total weight of the third pitch product, and an MCR of from about 10 wt % to about 60 wt %, based on the total weight of the third pitch product, wherein the third pitch product is suitable for spinning into carbon fiber.

The effluent of bottoms product 122 may have a T50 in the range of about 500° C. to about 650° C. (or about 525° C. to about 625° C., or about 550° C. to about 600° C.), a hydrogen content of about 4 wt % to about 8 wt % (or about 4.5 wt % to about 8 wt %, or about 5 wt % to about 8 wt %, or about 5.2 wt % to about 7.8 wt %, or about 5.4 wt % to about 7.6 wt %, or about 5.6 wt % to about 7.4 wt %, or about 5.8 wt % to about 7.2 wt %, or about 6 wt % to about 7 wt %), based on the total weight of the heat treated pitch product.

Methods of the present disclosure may further comprise: separating the hydrotreated product effluent 116 downstream of a hydrotreating zone to produce at least a liquid effluent (not shown); and recycling the liquid effluent back to the upstream of the hydrotreating zone 112 (not shown). In a configuration not shown in FIG. 1, the first effluent 108 may be combined with the liquid effluent from the recycle portion of the liquid effluent that has been separated from the hydrotreated product effluent 116, prior to the mixture entering hydrotreating zone 112. Alternatively, the recycle portion of the liquid effluent can be mixed with the one or more crude oils 102 prior to entering in steam cracking zone 104. Alternately, a separate solvent can be added in place of or in addition to the recycle portion of the liquid effluent. A weight ratio of the liquid effluent to the first effluent 108 may be about 0.1 to about 10 (or about 0.4 to about 8, or about 0.6 to about 6, or about 0.8 to about 4, or about 1 to about 2). Separating the hydrotreated product effluent 116 may be carried out by one or more of: distillation, deasphaltenation, chromatographic separation, membrane-filtration, or a combination thereof. The pitch composition may be characterized as being relatively free of impurities and ash.

Figure 2:
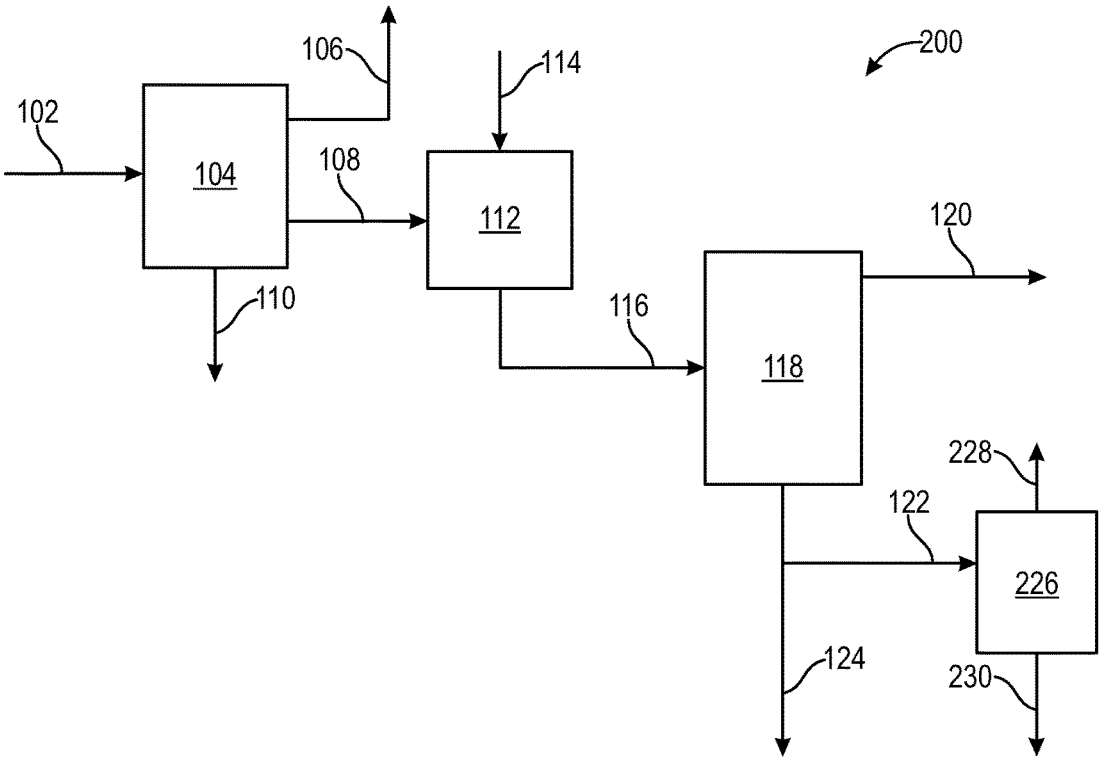
FIG. 2 is another non-limiting example flow diagram of a method 200 for producing spinnable pitches from steam cracked crude oils of the present disclosure.

FIG. 2 is another non-limiting example flow diagram of a method 200 for producing pitch compositions suitable for spinning into fibers, from steam cracking of crude oils. In this method, effluent of bottoms product 122 may be separated by deasphaltenation in deasphalting unit 226, in presence of a solvent, to produce a first portion 228 comprising solvent and soluble compounds, and a second portion 230 comprising solvent and a deasphalted bottom product. Herein, the deasphalted bottom product of second portion 230 may comprise a third pitch product having a softening point $T_{sp}$ of about 350° C. or less (or a softening point $T_{sp}$ of about 25° C. or greater), a hydrogen content of about 4 wt % to about 12 wt % (or about 4 wt % to about 11 wt %, or about 4 wt % to about 10 wt %, or about 5 wt % to about 9 wt %, or about 5 wt % to about 8 wt %, or about 5.2 wt % to about 7.8 wt %, or about 5.4 wt % to about 7.6 wt %, or about 5.6 wt % to about 7.4 wt %, or about 5.8 wt % to about 7.2 wt %, or about 6 wt % to about 7 wt %), based on the total weight of the third pitch product, and an MCR of from about 20 wt % to about 95 wt % (or from about 25 wt % to about 75 wt %, or from about 25 wt % to about 55 wt %, or from about 30 wt % to about 50 wt %, or from about 35 wt % to about 45 wt %), based on the total weight of the third pitch product, wherein the third pitch product is suitable for spinning into carbon fiber. The solvent may be selected from a group consisting of: ethane, propanes, butanes, pentanes, hexanes, benzene, heptanes, toluene, octanes, dimethylbenzenes, or any isomers therefrom, or any combination thereof.

Methods of the present disclosure may further comprise: performing a vacuum distillation on at least a portion of the deasphalted bottom product to produce a vacuum gas oil product and a vacuum bottoms product; and producing a fuel oil from at least a portion of the vacuum gas oil product, wherein the fuel oil has a sulfur content of 1 wt % or less.

Figure 3:
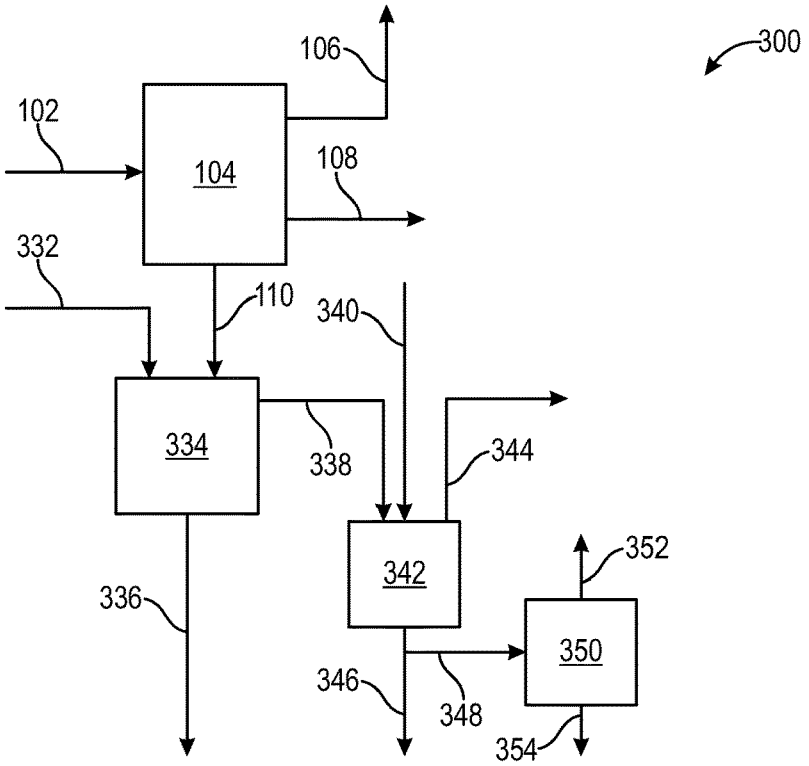
FIG. 3 is another non-limiting example flow diagram of a method 300 for producing spinnable pitches from steam cracked crude oils of the present disclosure.

FIG. 3 is another non-limiting example flow diagram of a method 300 for producing pitch compositions suitable for spinning into fibers, from steam cracking of crude oils. Herein, methods of the present disclosure further comprise: solvent deasphalting at least a portion of third effluent 110 in deasphalting unit 334 to produce deasphalted oil fraction 338 and deasphalting residue 336.

The deasphalted oil fraction 338 may have a T50 in the range of about 250° C. to about 650° C. (or about 300° C. to about 640° C., or about 325° C. to about 630° C., or about 350° C. to about 620° C., or about 375° C. to about 610° C., or about 400° C. to about 600° C.), an MCR of about 10 wt % to about 50 wt % (or about 15 wt % to about 45 wt %, or about 20 wt % to about 40 wt %, or about 25 wt % to about 30 wt %), a hydrogen content of about 6 wt % to about 20 wt % (or about 6.5 wt % to about 18 wt %, or about 7 wt % to about 16 wt %, or about 7.5 wt % to about 14 wt %, or about 8 wt % to about 12 wt %, or about 8.5 wt % to about 11 wt %), a sulfur content of about 5 wt % or less (or about 4.5 wt % or less, or about 4 wt % or less, or about 3.5 wt % or less, or about 3 wt % or less, or about 2.5 wt % or less, or about 2 wt % or less, or about 1.5 wt % or less, or about 1 wt % or less, or about 0.5 wt % or less, or about 0.2 wt % or less, or about 0.1 wt % or less), based on the total weight of the deasphalted oil fraction.

Methods of the present disclosure may further comprise: at least partially removing the deasphalting residue 336 for further processing (e.g., HDT Rock VR, POx, or pitch production).

As illustrated in FIG. 3, methods of the present disclosure may further comprise: hydrotreating the deasphalted oil fraction 338 in a hydrotreating zone 342, in presence of hydrogen 340, to produce an effluent 344 comprising a mixture of gas and liquid compounds (formed from the hydrotreating process in hydrotreating zone 342), and a hydrotreated product effluent 348 comprising heavy hydrocarbons (e.g., HDT Rock VR). The hydrotreated product effluent 348 may have a T50 in the range of about 300° C. to about 800° C. (or about 400° C. to about 700° C., or about 425° C. to about 675° C.), an MCR of about 20 wt % to about 80 wt % (or about 30 wt % to about 70 wt %, or about 40 wt % to about 60 wt %), a hydrogen content of about 6 wt % to about 20 wt % (or about 6.5 wt % to about 18 wt %, or about 7 wt % to about 16 wt %, or about 7.5 wt % to about 14 wt %, or about 8 wt % to about 12 wt %, or about 8.5 wt % to about 11 wt %), a sulfur content of about 5 wt % or less (or about 4.5 wt % or less, or about 4 wt % or less, or about 3.5 wt % or less, or about 3 wt % or less, or about 2.5 wt % or less, or about 2 wt % or less, or about 1.5 wt % or less, or about 1 wt % or less, or about 0.5 wt % or less, or about 0.2 wt % or less, or about 0.1 wt % or less), based on the total weight of the hydrotreated product effluent 348 fraction. Methods of the present disclosure may further comprise: at least partially removing the hydrotreated product effluent 348 for further processing 346 (e.g., deasphalting HDT Rock VR; pyrolyzing HDT Rock VR to produce mesophase and isotropic pitch).

Methods of the present disclosure may further comprise: solvent deasphalting the hydrotreated product effluent 348 comprising heavy hydrocarbons in a deasphalting unit 350 to produce a deasphalted oil fraction 352 and a deasphalting residue 354. Deasphalted oil fraction 352 and deasphalting residue 354 may be further submitted to additional processing for isotropic pitch and mesophase pitch production, for example.

The solvent deasphalting of the hydrotreated product effluent 348 may occur in the presence of a solvent. Suitable examples of solvent may be selected from a group consisting of: ethane, propanes, butanes, pentanes, hexanes, benzene, heptanes, toluene, octanes, dimethylbenzenes, or any isomers therefrom, or any combination thereof.

Herein, hydrotreating the deasphalted oil fraction 338 in a hydrotreating zone 342 may comprise: introducing a hydrogen stream 340 into hydrotreating zone 342. Hydrotreating conditions in hydrotreating zone 342 may be the same as the hydrotreating conditions in hydrotreating zone 112. For example, hydrotreating the deasphalted oil fraction 338 may be carried out catalytically, thermally, or a combination thereof.

Hydrotreating the deasphalted oil fraction 338 may comprise one or more of: a partial pressure of hydrogen of about 3,500 psig or less (or about 3,250 psig or less, or about 3,000 psig or less, or about 2,500 psig or less, or about 2,000 psig or less, or about 1,500 psig or less, or about 1,000 psig or less, or about 500 psig or less, or about 250 psig or less, or about 100 psig or less, or about 50 psig or less), a temperature in the range of about 200° C. to about 500° C. (or about 225° C. to about 490° C., or about 250° C. to about 480° C., or about 275° C. to about 470° C.), a pressure in the range of about 72 psig to about 3,000 psig (or about 600 psig to about 1,900 psig, or about 700 psig to about 1,800 psig, or about 800 psig to about 1,700 psig, or about 900 psig to about 1,600 psig, or about 1,000 psig to about 1,500 psig), a time residency of about 5 minutes or greater (or about 10 minutes or greater, or about 15 minutes or greater, or about 20 minutes or greater, or about 25 minutes or greater, or about 30 minutes or greater, or about 1 hour or greater, or about 2 hour or greater, or about 3 hour or greater, or about 4 hour or greater, or about 5 hour or greater, or about 6 hour or greater, or about 7 hour or greater, or about 8 hour or greater, or about 9 hour or greater, or about 10 hour or greater, and an LHSV in the range of about 0.1 $hr^{-1}$ to about 12 $hr^{-1}$ (or about 0.5 $hr^{-1}$ to about 10 $hr^{-1}$, or about 0.75 $hr^{-1}$ to about 8 $hr^{-1}$, or about 1 $hr^{-1}$ to about 6 $hr^{-1}$, or about 1 $hr^{-1}$ to about 4 $hr^{-1}$). The hydrotreating may be continuous, semi-batch, or a batch process.

Hydrotreating the deasphalted oil fraction 338 may be carried out catalytically using a catalyst system comprising: one or more transition metal catalysts comprising a group 5, 6, 9, 10 transition metal; and one or more supports. The one or more transition metal catalysts comprises a transition metal selected from the group consisting of: V, Mo, W, Co, Ni, Pt, Pd, or any combination thereof. The one or more supports are selected from the group consisting of: alumina, silica, silica-alumina, porous carbons, zeolites, zirconia, titania, and refractory oxides. Hydrotreating the deasphalted oil fraction 338 may be carried out in presence of a hydrogen-donor solvent comprising at least one aromatic ring.

Figure 4:
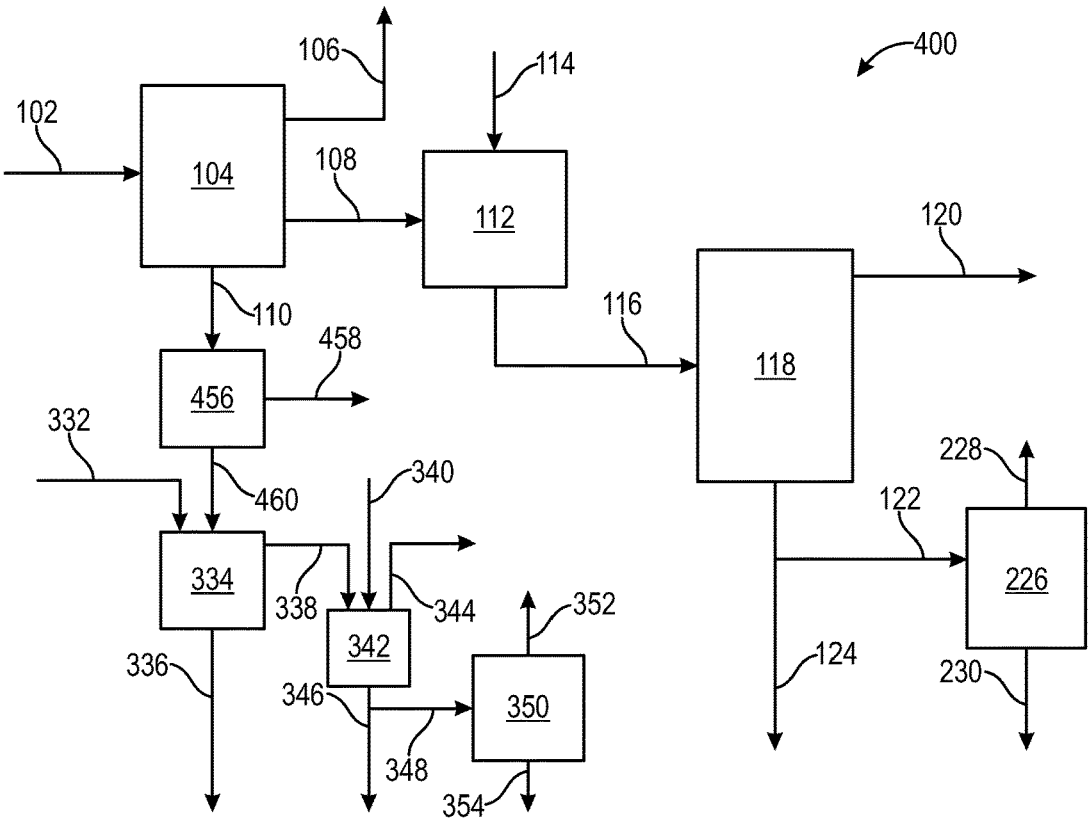
FIG. 4 is another non-limiting example flow diagram of a method 400 for producing spinnable pitches from steam cracked crude oils of the present disclosure.

FIG. 4 is another non-limiting example flow diagram of a method 400 for producing pitch compositions suitable for spinning into fibers, from steam cracking of crude oils. In this method, at least a portion of the third effluent 110 is hydrotreated in hydrotreating zone 456, prior to solvent deasphalting in deasphalting unit 334, thus to produce an effluent 458 comprising a gas oil portion, and a hydrotreated effluent 460, wherein the hydrotreated effluent 460 comprises a pitch product having an MCR of from 0 wt % to about 60 wt % (or about 1 wt % to about 50 wt %, or about 2 wt % to about 40 wt %, or about 5 wt % to about 30 wt %), based on the total weight of the hydrotreated effluent 460, a softening point $T_{sp}$ of about 400° C. or less (or about 350° C. or less, or about 300° C. or less, or about 250° C. or less, or about 200° C. or less, or about 150° C. or less, or about 100° C. or less), wherein the pitch product of hydrotreated effluent 460 is suitable for spinning into carbon fiber. Hydrotreated effluent 460 may then be separated in solvent deasphalting unit 334 for further processing, as described above.

The pitch compositions of the present disclosure, particularly the structure, optical texture and composition of the mesophase pitches, can be evaluated and analyzed by X-ray scattering and/or optical microscopy. The X-ray scattering patterns can be processed to deduce the following crystallographic parameters of the pitch compositions: the interlayer spacing, d (002), the stacking height (Lc), the layer diameter ($L_a$), and the number of molecules (N) in the stack.

X-ray scattering measurements can be performed in a synchrotron beamline (e.g., at Advanced Photon source 9-ID, at Argonne National lab which couples Bonse-Hart ultra-small angle X-ray scattering (USAXS) (Si 220 crystals) design with pin-hole collimated small angle X-ray scattering (SAXS) and wide-angle X-ray scattering (WAXS) configuration). For the beamline, a standard configuration with an energy of 21 keV can be used. The data represent a q-range covered by SAXS and WAXS detector. For example, the data can be taken with an exposure time of 15 and 30 seconds for SAXS/WAXS, respectively. The calibration of all the resultant 2-D SAXS and WAXS patterns can be performed by using a silver behenate standard (d-spacing of 58.38 Å) and $LaB_6$ standard (a=4.156 Å), respectively. The data may be subsequently integrated to obtain 1-D plots of scattered intensity (I) versus the scattering vector, q, where $q=4\pi \sin(\theta)/\lambda$, where $2\theta$ is the scattering angle relative to the incident beam direction. For X-ray data processing, Irena-Nika-USAXS package can be used (described by J. Ilaysky and P. R. Jemian in *Journal of Applied Crystallography* (2009), volume 42, pages 347-353; and by J. Ilaysky in *Journal Of Applied Crystallography* (2012), volume 45(2), pages 324-328, which are incorporated herein by reference). Samples can be prepared inside kapton tubes of 1.5 mm diameter. The measurements can be performed at room temperature.

Herein, the mesophase pitch compositions may comprise polyaromatic sheets which tend to form locally ordered associations with more or less parallel and/or equidistant sheets (stacks). The stack height ($L_C$) can be estimated by the formula;

$$L_C = K\frac{2\pi}{\Delta q};$$

the shape factor K is chosen to be unity. The number of molecules (N) in the stack can be estimated by, $N=L_C/d(002)+1$. The interplanar spacing, d $$(002) = \frac{2\pi}{q^*};$$

where q* the peak maximum.

The mesophase pitch composition of the present disclosure may have a stack height ($L_C$) of about 2 nm or greater (or about 3 nm or greater, or about 3.5 nm or greater, or about 3.75 nm or greater, or about 4 nm or greater, or about 4.25 nm or greater, or about 4.5 nm or greater). The mesophase pitch composition of the present disclosure may have a stack height ($L_C$) of about 2 nm to about 9 nm (or about 2.5 nm to about 8.5 nm, about 3 nm to about 8 nm, about 3.5 nm to about 7.5 nm, or about 4 nm to about 7 nm), as determined by X-ray scattering.

Methods of the present disclosure may further comprise: producing a fiber from any of the pitch products described above, wherein the fiber can be an oxidized fiber, carbonized fiber, graphitized fiber, fiber web, oxidized fiber web, carbonized fiber web, or graphitized fiber web. Production of fibers, carbon fibers, carbon articles, and carbon composites are further described.

FIGS. 1, 2, 3, and 4 provide non-limiting examples and descriptions of methods and systems of the present disclosure, wherein the said methods and systems can produce a feed that can be subsequently converted into a mesophase pitch, or an isotropic pitch that has a higher softening point than the feed. For instance, effluent 108 could be pyrolyzed to produce a heat treated product, which when deasphalted, can produce an isotropic pitch. This isotropic pitch could be further heat treated to yield a mesophase pitch. Similarly, effluent 122 could be pyrolyzed to produce a heat treated product, which when deasphalted, can produce an isotropic pitch. This isotropic pitch could be further heat treated to yield a mesophase pitch.

FIGS. 1, 2, 3, and 4 provide non-limiting examples and descriptions of methods and systems of the present disclosure. One skilled in the art will recognize other components that may be included for proper and safe operability of said methods. Examples of other components may include, but are not limited to, flow meters, sensors, heat exchangers, valves, and the like, and any combination thereof.

The methods of the present disclosure may further comprise producing a carbon article comprising the carbon fiber composite, binder pitch, graphitizable carbon microbeads, solid lubricants, activated carbon fiber, battery anodes, or carbon foams. Examples of carbon articles are described further below.

Spinning Pitch into Fibers

After separation, pitch compositions of the present disclosure can be spun directly into a fiber.

In some cases, a first pitch may be spun in combination with a second pitch, wherein the viscosity of the first pitch at a spinning temperature may be different from the viscosity of the second pitch at a spinning temperature. In some instances, the viscosity of the first pitch may be greater than the viscosity of the second pitch. In other instances, the viscosity of the first pitch may be lower than the viscosity of the second pitch. It may be desirable and advantageous to blend two or more pitches to control melt spinning or to control the properties of the corresponding carbon fiber formed therefrom (e.g, tensile strength). More specifically, a first pitch may be spun in combination with a second pitch, wherein the first pitch may form a first carbon fiber as a first layer (i.e., an inner/central layer) and the second pitch may form a second carbon fiber as a second layer (i.e., an outer layer), thus on the surface of the first layer. Other non-limiting examples, may include: 1) having the second pitch formed on the surface of the first pitch, wherein the second pitch has a greater rate of reaction with air than the first pitch to produce an oxidized layer, thus preventing the fiber from sticking during winding; 2) having a pitch that is stiffer on the outside than on the inside; 3) having a pitch that is more tolerant to surface defects on the outside than the inside; 4) having the second pitch primarily used to produce a much narrower fiber in the central/internal layer in order to increase the strength of the central/internal fiber layer; 5) having the second pitch that forms a better interface with a matrix. For example, using two different pitches in a bicomponent spinning machine to produce fibers that have different materials (pitches) geometrically positioned along the filament (fiber) long axis. For example, one can create "side-by-side" fibers wherein two pitches lie along the long axis of the fiber. In other examples, one can make other geometric placements such as "sheath and core" fibers. Nonlimiting examples of placements may include "tipped trilobal," "islands in the sea," or other suitable geometries. In some cases, the pitch product, the hydrotreated pitch product, and/or the third pitch product may have different viscosities.

Methods of the present disclosure may comprise: producing a carbon fiber from a pitch composition (isotropic and/or anistropic pitch composition having a mesophase content of less than 10 vol %, alternately a mesophase content of 10 vol % or greater, based on the total volume of the pitch composition) described above.

The spinning pitch-based carbon fiber may be a melt spinning process. The process may use a pitch composition with a softening point of 50° C. to 400° C. (or greater than 110° C., or greater than 120° C., or greater than 130° C., or greater than 140° C., or greater than 150° C., or greater than 160° C., or greater than 170° C., or greater than 180° C., or greater than 190° C., or greater than 200° C., or greater than 250° C., or greater than 300° C., or greater than 320° C.). The pitch composition of the present disclosure may be introduced to an extruder wherein the said pitch composition can be heated, sheared and extruded through capillaries to form the carbon fiber. The spinning process may produce continuous fibers, or fibrous webs. The spun fibers, or fibrous webs, may subsequently be stabilized, carbonized, or graphitized.

Carbon Fiber Composites, and Methods for Production Thereof.

The present disclosure further provides a method for forming a composite material where a carbon fiber can be formed from a single pitch or a blend of two or more pitches, and a matrix. The matrix may be, for example, a thermoset matrix, a thermoplastic matrix, or a combination thereof.

The carbon fiber composite may comprise a carbon fiber produced from a pitch product of the present disclosure (as described above). The carbon fiber composite may contain from about 1 vol % to about 70 vol % of a carbon fiber and from about 99 vol % to about 30 vol % of a matrix, based on the total volume of the carbon fiber composite.

The matrix used herein can be produced from a thermoset polymer (e.g., cyclopentadiene, dicyclopentadiene, epoxy, pitch, phenolic resins, vinylester, polyimide and polyesters), a thermoplastic polymer (e.g., a thermoplastic polymer including one or more of: polyethylene, polypropylene, high-density polyethylene, linear low-density polyethylene, low-density polyethylene, polyamides, polyvinylchloride, polyetheretherketone, polyetherketoneketone, polyaryletherketone, polyetherimide and polyphenylene sulfide), cement, concrete, ceramic, metal, metal alloy, or a combination thereof. For example, a pitch itself can be used as a matrix and/or binder for a carbon fiber composite by impregnating a number of oxidized fiber, carbon fiber, or graphite fibers, or oxidized, carbonized, or graphitized fibrous webs with pitch and carbonizing the assemblage, thus enabling production of carbon-carbon composites. In such cases, the carbon fibers are laid into a desired form and then the fibers are impregnated, these materials are then carbonized at high temperatures to form a solid block of carbon, oftentimes the impregnation with pitch is repeated several times before the final carbon product is formed, this method is commonly employed when producing carbon brakes.

The present disclosure also relates to methods for making carbon fiber composites comprising: combining at least one composite filler comprising a carbon fiber produced from the forgoing spinnable pitch composition with at least one matrix, wherein the matrix is a thermoset matrix, a thermoplastic matrix, cement, concrete, ceramic, metal, metal alloy, or a combination thereof. The composite filler may be used in the carbon fiber composite after the stabilization, carbonization, or graphitization processes. The composite filler can be either short, or continuous, mat, bundle, unidirectional or multidirectional, and woven or non-woven. The carbon fiber composite parts can be produced using conventional molding, roving, autoclave and pultrusion processes.

The described carbon fiber composites exhibit superior stiffness, strength, corrosion resistance, density, thermal and/or electrical conductivities, than similar composites that do not incorporate carbon fibers. In addition, reinforcement of a composite with carbon fiber versus other strengthening agents tend to be lighter in weight and exhibit higher specific strengths (strength normalized relative to mass). Additionally, such carbon fiber composites exhibit a low coefficient of thermal expansion, particularly where a high graphitic content fiber is used, this property can be enhanced by controlling the orientation/texture in pitch of the carbon fibers.

In at least one embodiment, methods of the present disclosure may comprise: producing a fiber from the pitch product, the hydrotreated pitch product, the third pitch product, or any combination thereof, wherein the pitch product, the hydrotreated pitch product, and/or the third pitch product may be obtained as described in methods 100, 200, 300, and/or 400, and wherein the fiber may be an oxidized fiber, carbonized fiber, graphitized fiber, fiber web, oxidized fiber web, carbonized fiber web, or graphitized fiber web.

In further embodiments, methods of the present disclosure may comprise: producing a fiber from pitch products produced from heat treating materials produced in methods 100, 200, 300, and/or 400, and wherein the fiber may be an oxidized fiber, carbonized fiber, graphitized fiber, fiber web, oxidized fiber web, carbonized fiber web, or graphitized fiber web.

Methods of the present disclosure may further comprise: producing a carbon article comprising the carbon fiber produced from the pitch product, the hydrotreated pitch product, and/or the third pitch product of methods 100, 200, 300, and/or 400. Additionally, stabilizing the fiber may be carried out at a stabilization temperature of less than or equal to $T_{sp}$ of the pitch product, the hydrotreated pitch product, and/or the third pitch product.

Methods of the present disclosure may further comprise: producing high-modulus, high-strength carbon fibers comprising: spinning one or more pitch products to produce a spun fiber; stabilizing the spun fiber with an oxidizing gas containing oxygen to produce a stabilized fiber; carbonizing the stabilized fiber to produce a carbonized fiber; and graphitizing the carbonized fiber. Carbonizing the stabilized fiber may be carried out at a carbonization temperature of about 1,000° C. or greater. The carbon fiber has a diameter of about 50 μm or less. The weight loss (wt %) of any of the pitch products at the spinning temperature may be about 1 wt % or less (or about 0.75 wt % or less, or about 0.5 wt % or less, or about 0.25 wt % or less). Herein, the carbon fiber may be produced in a melt blowing or melt spinning process.

Methods of the present disclosure may further comprise: producing high-modulus, high-strength carbon fiber fabric comprising: spinning one or more pitch products to produce a spun fiber; stabilizing the spun fiber with an oxidizing gas containing oxygen to produce a stabilized fiber; weaving a fabric from the stabilized fiber to produce a stabilized fabric; carbonizing the stabilized fabric to produce a carbonized fabric; and optionally graphitizing the carbonized fabric.

Methods of the present disclosure may further comprise: producing a composite comprising: producing a carbon fiber from the pitch product, the hydrotreated pitch product, the third pitch product, or any combination thereof; producing a first fabric from the carbon fiber; producing a first fiber-reinforced matrix material from the first fabric and a first matrix material; producing at least a second fiber-reinforced sheet from a second fabric, wherein the second fabric is produced from a second fiber and a second matrix material, and wherein the second fabric is produced from the same or different carbon fiber; and laminating the first fiber-reinforced sheet with the second fiber-reinforced sheet.

The first matrix material or the second matrix material may be a thermoset resin, a thermoplastic resin, cement, concrete, ceramic, metal, metal alloy, a pitch product, or a combination thereof.

The first matrix material may be a thermoplastic resin selected from a group consisting of: polyethylene, polypropylene, high-density polyethylene, linear low-density polyethylene, low-density polyethylene, polyester, epoxy, phenolic, vinyl ester, polyurethane, silicone, polyamide, or any combination thereof. The second fiber may be selected from a group consisting of: glass fiber, carbon fiber, aramid fiber, ceramic fibers, boron fibers, or any combination thereof.

The second matrix material may be a resin selected from a group consisting of: polyethylene, polypropylene, high-density polyethylene, linear low-density polyethylene, low-density polyethylene, polyester, epoxy, phenolic, vinyl ester, polyurethane, silicone, polyamide, or any combination thereof.

The first matrix material or the second matrix may be the pitch product, the hydrotreated pitch product, the third pitch product, or any combination thereof.

The composite may comprise a filler, wherein the filler is selected from a group consisting of: carbon fiber, glass fiber, metal fiber, boron fiber, or carbon black.

End Uses

Non-limiting examples of carbon articles may include automotive body parts (e.g., deck lids, hoods, front end, bumpers, doors, chassis, suspension systems such as leaf springs, drive shafts), off-shore tethers and drilling risers, wind turbine blades, insulating and sealing materials used in construction and road building (e.g., concrete), aircraft and space systems, high-performance aquatic vessels, airplanes, sports equipment, flying drones, armor, armored vehicles, military aircraft, energy storage systems, fireproof materials, lightweight cylinders and pressure vessels, and medical devices. Furthermore, fibers of the present disclosure (e.g., fiber filaments or webs) may be used as insulation materials (e.g., thermal or acoustic), or as shielding materials (e.g., electromagnetic or radio frequency), or in friction control surfaces (e.g., brake pads, such as aircraft brake pads). Further example, of carbon product applications may include graphitic foams for heat dissipation, protection against explosions and the like. Additional uses may include binder pitch, graphitizable carbon microbeads, solid lubricants, activated carbon fiber, and battery anodes.

To form the pitch compositions, and further the carbon fiber composites, in accordance with at least one embodiment of the present disclosure, the pitch compositions may be mixed according to any suitable mixing methods to produce the forgoing spinnable pitch composition, and spun into a pitch fiber. The as-spun pitch fiber may be subsequently oxidized to form a stabilized pitch fiber and may further undergo a carbonization and graphitization process under inert conditions to yield a carbon fiber filler. Stabilization, carbonization and graphitization conditions may be used according to methods apparent to those skilled in the art. The carbon fiber filler may comprise the stabilized, carbonized, or graphitized carbon fiber. Additionally, the carbon fiber filler may comprise a fibrous web, a stabilized fibrous web, carbonized fibrous web, or graphitized fibrous web. The carbon fiber filler may then be used to form the carbon articles and/or related pitch compositions.

Embodiments disclosed herein include:

A. Processes for making pitch compositions. The processes comprise: steam cracking of one or more crude oils in a steam cracking zone to produce a first effluent comprising a heavy oil mixture comprising a steam cracker tar, a second effluent comprising a mixture of gaseous products and liquid products, and a third effluent comprising one or more bottoms products; optionally introducing at least a portion of the first effluent from downstream of the steam cracking zone and/or at least a portion of the second effluent from downstream of the steam cracking zone and/or at least a portion of the third effluent from downstream of the steam cracking zone to one or more pretreating zones to produce a first effluent pretreated product and/or a second effluent pretreated product and/or a third effluent pretreated product; introducing the first effluent, the first effluent pretreated product, the second effluent, the second effluent pretreated product, the third effluent, the third effluent pretreated product, or any combination thereof, to a reaction zone; and heat treating the first effluent, the first effluent pretreated product, the second effluent, the second effluent pretreated product, the third effluent, the third effluent pretreated product, or any combination thereof, in the reaction zone to a temperature in the range of about 200° C. to about 800° C. to produce a first reaction effluent comprising a pitch product, and a second reaction effluent comprising a mixture of gaseous and liquid products, wherein the pitch product has a mesophase content from 0 vol % to 100 vol %, based on the total volume of the pitch product, an MCR in the range of about 40 wt % to about 95 wt %, and a softening point $T_{sp}$ in the range of about 50° C. to about 400° C.

B. Processes for making pitch compositions. The processes comprise: steam cracking of one or more crude oils in a steam cracking zone to produce a first effluent comprising a heavy oil mixture comprising a steam cracker tar, a second effluent comprising a mixture of gaseous products and liquid products, and a third effluent comprising one or more bottoms products, wherein the first effluent is sent directly to the reaction zone for heat treatment and the first reaction effluent and/or the second reaction effluent are/is sent to a separation zone to produce at least one pitch product and a separated reaction effluent comprised of gaseous and liquid hydrocarbons; introducing the first effluent, the first effluent pretreated product, the second effluent, the second effluent pretreated product, the third effluent, the third effluent pretreated product, or any combination thereof, to a reaction zone; and heat treating the first effluent, the first effluent pretreated product, the second effluent, the second effluent pretreated product, the third effluent, the third effluent pretreated product, or any combination thereof, in the reaction zone to a temperature in the range of about 200° C. to about 800° C. to produce a first reaction effluent comprising a pitch product, and a second reaction effluent comprising a mixture of gaseous and liquid products, wherein the pitch product has a mesophase content from 0 vol % to 100 vol %, based on the total volume of the pitch product, an MCR in the range of about 40 wt % to about 95 wt %, and a softening point $T_{sp}$ in the range of about 50° C. to about 400° C.

Each of embodiments A and B may have one or more of the following elements in any combination:

Element 1: wherein the first effluent is sent directly to the reaction zone for heat treatment and the first reaction effluent and/or the second reaction effluent are/is sent to a separation zone to produce at least one pitch product and a separated reaction effluent comprised of gaseous and liquid hydrocarbons; and wherein the at least one pitch product has a mesophase content from 0 vol % to 100 vol %, based on the total volume of the at least one pitch product, an MCR in the range of about 40 wt % to about 95 wt %, based on the total weight of the at least one pitch product, and a softening point $T_{sp}$ in the range of about 50° C. to about 400° C.

Element 2: wherein the reaction effluent is separated by distillation, deasphaltenation, chromatographic separation, membrane-filtration, or any combination thereof.

Element 3: wherein deasphaltenation is carried out using a solvent selected from the group consisting of: ethane, propanes, butanes, pentanes, hexanes, heptanes, octanes, or any combinations thereof.

Element 4: wherein the one or more pretreating zones are one or more hydrotreating zones, wherein at least a portion of the first effluent is hydrotreated to produce the first effluent pretreated product, and wherein the first effluent pretreated product is a hydrotreated first effluent product.

Element 5: separating the first effluent pretreated product to produce at least one distillable product, and one non-distillable product.

Element 6: wherein the first effluent pretreated product is separated by distillation.

Element 7: heat treating the non-distillable product to produce a reaction effluent; separating the reaction effluent to produce a heat treated pitch product and a separated reaction effluent; wherein the separated reaction effluent comprises gaseous and liquid hydrocarbons; and wherein the heat treated pitch product has a mesophase content from 0 vol % to 100 vol %, based on the total volume of the heat treated pitch product, an MCR in the range of about 40 wt % to about 95 wt %, based on the total weight of the heat treated pitch product, and a softening point $T_{sp}$ in the range of about 50° C. to about 400° C.

Element 8: wherein the reaction effluent is separated by distillation, deasphaltenation, chromatographic separation, membrane-filtration, or any combination thereof.

Element 9: wherein the pitch product has a stack height ($L_C$) of about 2 nm to about 9 nm, as determined by X-ray scattering.

Element 10: separating the heat treated reaction effluent in a separation zone to produce at least one pitch product, and a separated reaction effluent comprised of gaseous and liquid hydrocarbons, wherein the at least one pitch product has a mesophase content from 0 vol % to 100 vol %, based on the total volume of the at least one pitch product, an MCR in the range of about 40 wt % to about 95 wt %, based on the total weight of the at least one pitch product, and a softening point $T_{sp}$ in the range of about 50° C. to about 400° C.

Element 11: wherein the heat treated reaction effluent is separated by distillation, deasphaltenation, chromatographic separation, membrane-filtration, or any combination thereof.

Element 12: wherein the third effluent comprising one or more bottoms products is sent to a first separation zone to produce at least a first separation product and a second separation product, wherein at least a portion of the first separation product, or at least a portion of the second separation product is sent to a reaction zone to produce a reaction effluent.

Element 13: separating the reaction effluent produced from at least a portion of the first separation product, or at least a portion of the second separation product to a second separation zone to produce at least one pitch product, and a separated reaction effluent comprised of gaseous and liquid hydrocarbons, wherein the at least one pitch product has a mesophase content from 0 vol % to 100 vol %, based on the total volume of the at least one pitch product, an MCR in the range of about 40 wt % to about 95 wt %, based on the total weight of the at least one pitch product, and a softening point $T_{sp}$ in the range of about 50° C. to about 400° C.

Element 14: wherein the first and second separation zones are independently selected from the group consisting of: distillation, deasphaltenation, chromatographic separation, membrane-filtration, or any combination thereof.

Element 15: wherein the reaction zone is a tubular, batch, semi-batch, or continuous stirred tank reactor, and is either a thermal, or catalytic process.

Element 16: wherein the reaction zone is a thermal process or catalytic process.

Element 17: wherein the one or more crude oils have a T50 in the range of from about 240° C. to about 440° C., an MCR of about 25 wt % or less, a sulfur content of about 5 wt % or less, based on the total weight of the one or more crude oils.

Element 18: wherein the one or more crude oils have a T10 in the range of from about to about 350° C., a T90 in the range of from about 300° C. to about 700° C., a hydrogen content of about 20 wt % or less, a n-heptane asphaltenes content of about 15 wt % or less, based on the total weight of the one or more crude oils.

Element 19: wherein the first effluent has at least about 70 wt % of the mixture having a boiling point at atmospheric pressure that is greater than about 200° C., an MCR of about 5 wt % to about 55 wt %, a hydrogen content of about 4 wt % to about 10 wt %, a sulfur content of about 5 wt % or less, based on the total weight of the first effluent.

Element 20: combining the first effluent with a fluxant agent to produce a fluxed effluent.

Element 21: wherein the fluxant agent is selected from the group consisting of: reformate, steam cracker naphtha, steam cracked gas oil (SCGO), atmospheric gas oil (AGO), heavy atmospheric gas oil (HAGO), vacuum gas oil (VGO), heavy vacuum gas oil, coker naphtha, light coker gas oil, heavy coker gas oil, main column bottoms, light cycle oil, heavy diesel oil (HDO), and any combination thereof.

Element 22: wherein the pitch product has a mesophase content of about 10 vol % or less, based on the total volume of the pitch product.

Element 23: wherein the pitch product has a mesophase content of about 10 vol % to 100 vol %, based on the total volume of the pitch product.

Element 24: wherein the pitch product has a quinoline insoluble (QI) content of about 60 wt % or less.

Element 25: wherein the pitch product has $T_{sp}$ of about 100° C. or greater.

Element 26: wherein the pitch product has $T_g$ of about 70° C. or greater.

Element 27: wherein the pitch product is sent to one or more heat treating zones to produce a heat treated pitch product having an MCR and a $T_{sp}$ both greater than the MCR and the $T_{sp}$ of the pitch product, and wherein the pitch product and/or the heat treated pitch product are suitable for spinning into carbon fiber.

Element 28: wherein the heat treated pitch product has one or more of: a mesophase content of about 50 vol % or greater, based on the total volume of the heat treated pitch product; a quinoline insoluble (QI) content of about 10 wt % or greater, based on the total weight of the heat treated pitch product; and a $T_{sp}$ of about 200° C. or greater.

Element 29: wherein hydrotreating is performed catalytically, thermally, or a combination thereof.

Element 30: wherein hydrotreating comprise one or more of: a partial pressure of hydrogen of about 3,500 psig or less, a temperature in the range of about 200° C. to about 500° C., a pressure in the range of about 72 psig to about 3,000 psig, a time residency of about 5 minutes or greater, and an LHSV in the range of about 0.1 $hr^{-1}$ to about 12 $hr^{-1}$.

Element 31: wherein hydrotreating is performed catalytically using a catalyst system comprising: one or more transition metal catalysts comprising a group 5, 6, 9, 10 transition metal; and one or more supports.

Element 32: wherein the one or more transition metal catalysts comprises a transition metal selected from the group consisting of: V, Mo, W, Co, Ni, Pt, Pd, or any combination thereof.

Element 33: wherein the one or more supports are selected from the group consisting of: alumina, silica, silica-alumina, porous carbons, zeolites, zirconia, titania, and refractory oxides.

Element 34: wherein hydrotreating is performed in presence of a hydrogen-donor solvent.

Element 35: wherein the hydrogen-donor solvent contains at least one single-ring aromatic compound.

Element 36: wherein the hydrotreated product effluent has a T50 in the range of about 225° C. to about 375° C., a hydrogen content of about 7 wt % to about 12 wt %, a sulfur content of from 0 wt % to about 1 wt %, based on the total weight of the hydrotreated product effluent.

Element 37: wherein the heat treated pitch product has a T10 in the range of about 500° C. to about 650° C., a hydrogen content of about 4 wt % to about 8 wt %.

Element 38: wherein hydrotreating is a continuous fixed-bed process.

Element 39: separating the hydrotreated product effluent downstream of a hydrotreating zone to produce at least a liquid effluent; and recycling the liquid effluent back to the upstream of the hydrotreating zone.

Element 40: wherein a weight ratio of the liquid effluent to the first effluent is about to about 10.

Element 41: wherein separating the hydrotreated product effluent is carried out by one or more of: distillation, deasphaltenation, chromatographic separation, membrane-filtration, or a combination thereof.

Element 42: separating the effluent of bottoms product by deasphaltenation in the presence of a solvent to produce a first portion comprising solvent and soluble compounds, and a second portion comprising solvent and a deasphalted bottom product, wherein the deasphalted bottom product comprises a third pitch product having a softening point $T_{sp}$ of about 25° C. or greater, a hydrogen content of about 4 wt % to about 12 wt %, based on the total weight of the third pitch product, and an MCR of from about 10 wt % to about 60 wt %, based on the total weight of the third pitch product, wherein the third pitch product is suitable for spinning into carbon fiber.

Element 43: wherein the solvent is selected from a group consisting of: ethane, propanes, butanes, pentanes, hexanes, benzene, heptanes, toluene, octanes, dimethylbenzenes, or any isomers therefrom, or any combination thereof.

Element 44: performing a vacuum distillation on at least a portion of the deasphalted bottom product to produce a vacuum gas oil product and a vacuum bottoms product; and producing a fuel oil from at least a portion of the vacuum gas oil product, wherein the fuel oil has a sulfur content of about 1 wt % or less.

Element 45: solvent deasphalting at least a portion of the third effluent in a deasphalting unit to produce a deasphalted oil fraction and a deasphalting residue.

Element 2: wherein the deasphalted oil fraction has a T50 in the range of about 250° C. to about 650° C., an MCR of about 10 wt % to about 50 wt %, a hydrogen content of about 6 wt % to about 20 wt %, a sulfur content of about 5 wt % or less, based on the total weight of the deasphalted oil fraction.

Element 46: at least partially removing the deasphalting residue for further processing.

Element 47: hydrotreating the deasphalted oil fraction in a hydrotreating zone to produce a hydrotreated product effluent comprising heavy hydrocarbons.

Element 48: wherein hydrotreating the deasphalted oil fraction is performed catalytically, thermally, or a combination thereof.

Element 49: wherein hydrotreating the deasphalted oil fraction comprises one or more of: a partial pressure of hydrogen of about 3,500 psig or less, a temperature in the range of about 200° C. to about 500° C., a pressure in the range of about 72 psig to about 3,000 psig, a time residency of about 5 minutes or greater, and an LHSV in the range of about 0.1 $hr^{-1}$ to about 12 $hr^{-1}$.

Element 50: wherein hydrotreating the deasphalted oil fraction is performed catalytically using a catalyst system comprising: one or more transition metal catalysts comprising a group 5, 6, 9, 10 transition metal; and one or more supports.

Element 51: wherein the one or more transition metal catalysts comprises a transition metal selected from the group consisting of: V, Mo, W, Co, Ni, Pt, Pd, or any combination thereof.

Element 52: wherein the one or more supports are selected from the group consisting of: alumina, silica, silica-alumina, porous carbons, zeolites, zirconia, titania, and refractory oxides.

Element 53: wherein hydrotreating the deasphalted oil fraction is performed in presence of a hydrogen-donor solvent comprising at least one aromatic ring.

Element 54: separating the hydrotreated product by distillation into at least one bottoms fraction; and solvent deasphalting the hydrotreated bottoms fraction comprising heavy hydrocarbons in a deasphalting unit to produce a deasphalted oil fraction and a deasphalting residue.

Element 55 wherein solvent deasphalting occurs in presence of a solvent.

Element 57: wherein the solvent is selected from a group consisting of: ethane, propanes, butanes, pentanes, hexanes, benzene, heptanes, toluene, octanes, dimethylbenzenes, or any isomers therefrom, or any combination thereof.

Element 58: producing a fiber from the pitch product, the hydrotreated pitch product, the third pitch product, or any combination thereof, wherein the fiber is an oxidized fiber, carbonized fiber, graphitized fiber, fiber web, oxidized fiber web, carbonized fiber web, or graphitized fiber web.

Element 59: mixing the pitch product, the hydrotreated pitch product, the third pitch product, or any combination thereof, with a needle coke to produce a carbon article capable of forming an electrode for iron and/or aluminum production.

Element 60: mixing the pitch product, the hydrotreated pitch product, the third pitch product, or any combination thereof, with a carbon fiber to produce a carbon article capable of forming carbon-carbon composites.

Element 61: wherein the pitch product, the hydrotreated pitch product, and/or the third pitch product have different viscosities.

Element 62: wherein the pitch product, the hydrotreated pitch product, the third pitch product, each have different softening points $T_{sp}$.

Element 63: producing a carbon article comprising the carbon fiber.

Element 64: wherein stabilizing the fiber is carried out at a stabilization temperature of less than or equal to $T_{sp}$ of the pitch product, the hydrotreated pitch product, or the third pitch product.

Element 65: producing high-modulus, high-strength carbon fibers comprising: spinning one or more pitch products to produce a spun fiber; stabilizing the spun fiber with an oxidizing gas containing oxygen to produce a stabilized fiber; and carbonizing the stabilized fiber to produce a carbonized fiber.

Element 66: graphitizing the carbonized fiber.

Element 67: wherein carbonizing the stabilized fiber is carried out at a carbonization temperature of about 1,000° C. or greater.

Element 68: wherein carbon fibers have a diameter of about 50 μm or less.

Element 69: wherein any of the pitch products have a weight loss (wt %) at spinning temperature of about 1 wt % or less.

Element 70: wherein the carbon fibers are produced in a melt blowing process.

Element 71: producing high-modulus, high-strength carbon fiber fabric comprising: spinning one or more pitch products to produce a spun fiber; stabilizing the spun fiber with an oxidizing gas containing oxygen to produce a stabilized fiber; weaving a fabric from the stabilized fiber to produce a stabilized fabric; carbonizing the stabilized fabric to produce a carbonized fabric; and optionally graphitizing the carbonized fabric.

Element 72: producing a composite comprising: producing a carbon fiber from the pitch product, the hydrotreated pitch product, the third pitch product, or any combination thereof; producing a first fabric from the carbon fiber; producing a first fiber-reinforced matrix material from the first fabric and a first matrix material; producing at least a second fiber-reinforced sheet from a second fabric, wherein the second fabric is produced from a second fiber and a second matrix material; and laminating the first fiber-reinforced sheet with the second fiber-reinforced sheet.

Element 73: wherein the first matrix material or the second matrix material is a thermoset resin, a thermoplastic resin, cement, concrete, ceramic, metal, metal alloy, a pitch product, or a combination thereof.

Element 74: wherein the first matrix material is a thermoplastic resin selected from a group consisting of: polyethylene, polypropylene, high-density polyethylene, linear low-density polyethylene, low-density polyethylene, polyimides, or any combination thereof.

Element 75: wherein the second fiber is selected from a group consisting of: glass fiber, carbon fiber, aramid fiber, ceramic fibers, boron fibers, or any combination thereof.

Element 76: wherein the second matrix material is a resin selected from a group consisting of: polyethylene, polypropylene, high-density polyethylene, linear low-density polyethylene, low-density polyethylene, polyester, epoxy, phenolic, vinyl ester, polyurethane, silicone, polyamide, or any combination thereof.

Element 77: wherein the first matrix material or the second matrix is the pitch product, the hydrotreated pitch product, the third pitch product, or any combination thereof.

Element 78: wherein the composite comprises a filler, wherein the filler is selected from a group consisting of: carbon fiber, glass fiber, metal fiber, boron fiber, or carbon black.

Element 79: introducing at least a portion of the first effluent from downstream of the steam cracking zone and/or at least a portion of the second effluent from downstream of the steam cracking zone and/or at least a portion of the third effluent from downstream of the steam cracking zone to one or more pretreating zones to produce a first effluent pretreated product and/or a second effluent pretreated product and/or the third effluent pretreated product.

By way of non-limiting example, exemplary combinations applicable to A include, but are not limited to: 1 and 2; 1 and 3; 1, 3 and 4; 1 and 3-5; 1, 3 and 5; 1, 4 and 5; 1 and 3-6; 1, 3, 5 and 6; 1, 4, 5 and 6; 1 and 4; 1 and 5; 1 and 7; 1 and 3-7; 1, 3, 5 and 7; 1, 4, 5 and 7; 1 and 8; 1 and 9; 1 and 10; 1 and 11; 3 and 4; 3-5; 3 and 5; 3-6; 3-7; 3, 4 and 7; 3 and 8; 3 and 9; 3 and 10; 3 and 11; 4 and 5; 4 and 6; 4-6; 4-7; 4 and 8; 4 and 9; 4 and 10; 4 and 11; 5 and 6; 5-7; 5 and 8; 5 and 9; 5 and 10; 5 and 11; 7 and 8; 7 and 9; 7 and 10; 7 and 11; 8 and 9; 8 and 10; 8 and 11; 9 and 10; 9 and 11; and 10 and 11; 1 or 2, and 3; 1 or 2, and 4; 1 or 2, and 5; 1 or 2, and 6; 1 or 2, and 6 and 7; 1 or 2, and 7; 1 or 2, and 8; 1 or 2, and 6-8; 1 or 2, and 7 and 8; 1 or 2, and 15; 1 or 2, and 16-32; 1 or 2, and 25-78.

To facilitate a better understanding of the embodiments of the present disclosure, the following examples of preferred or representative embodiments are given. In no way should the following examples be read to limit, or to define, the scope of the present disclosure.

EXAMPLES

A series of pitches were produced from steam cracking of crude oils.

Production of the Comparative Pitch Compositions:

Commercial isotropic petroleum pitch was used as a comparative example (Sample 1), with the following properties: a T10=402° C., a T50=569° C., and a T87=750° C., an MCR of 52.5 wt %, 93.45 wt % C, 5.50 wt % H, 0.23 wt % N, 0.51 wt % S, based on the total weight of the pitch, and a softening point of 127° C.

Representative Conditions for Heat Treating:

A glass vial was loaded with about 2 grams of a feed, and placed in a PAC Micro Carbon Residue Tester (MCRT). The sample was heated to 100° C. within 10 minutes under a flow of nitrogen (600 mL/min). Immediately afterwards, the sample was heated to 400° C. using a 30° C./min ramp rate and 600 mL/min nitrogen flow rate. Once at 400° C., the flow rate was decreased to 150 mL/min. The sample was held at 400° C. for a specified period of time (see Tables 1-9), under a continuous nitrogen flow of 150 mL/min. After heat soaking at 400° C., the sample was cooled to ambient temperature under nitrogen atmosphere, at a 600 mL/min flow rate over the course of several hours. Typically, after about 15 minutes, the temperature was about 350° C.; after about 25 minutes, the temperature was about 300° C.; and after about 66 min, the temperature was about 200° C.; and after about 157 min, the temperature was about 100° C.

Table 1 illustrates the results obtained after heat treatment of a commercial comparative pitch (Sample 1).

TABLE 1

| Sample | Time (h) | T (° C.) | Yield (wt %) | $T_{sp}$ (° C.) | MCR (wt %) |
|---|---|---|---|---|---|
| 1 | 0 | 400 | N/A | 127 | 52.5 |
| 2 | 1 | 400 | 77.5 | N/D | 66.6 |
| 3 | 2 | 400 | 69.1 | 218.3 | 76.9 |
| 4 | 3 | 400 | 61.1 | 290.9 | 84.40 |
| 5 | 3 | 400 | 63.7 | N/D | 85.12 |
| 6 | 4 | 400 | 60.5 | 321.6 | 87.8 |
| 7 | 4 | 400 | N/D | N/D | 88.2 |
| 8 | 6 | 400 | 58 | 377.8 | 94.63 |
| 9 | 6 | 400 | 63.6 | N/D | 93.78 |

| Sample | C (wt %) | H (wt %) | N (wt %) | S (wt %) | Mesophase Content (vol %) |
|---|---|---|---|---|---|
| 1 | 93.39 | 6.01 | 0.23 | 0.45 | 0 |
| 2 | 94.26 | 5.11 | 0.18 | 0.54 | 12 |
| 3 | 94.45 | 4.76 | 0.31 | 0.38 | 37 |
| 4 | 94.84 | 4.61 | N/D | 0.39 | 47 |
| 5 | 94.76 | 4.62 | 0.21 | 0.37 | 38 |
| 6 | 94.74 | 4.74 | 0.21 | 0.36 | 54 |
| 7 | 94.91 | 4.60 | 0.25 | 0.36 | 43 |
| 8 | 94.87 | 4.46 | 0.23 | 0.30 | 81 |
| 9 | 94.21 | 4.20 | 0.10 | 0.36 | 81 |

Table 2 illustrates the results obtained after heat treatment of hydrotreated steam cracker tar (Sample 10).

TABLE 2

| Sample | Time (h) | T (° C.) | Yield (wt %) | $T_{sp}$ (° C.) | MCR (wt %) |
|---|---|---|---|---|---|
| 10 | 0 | N/A | N/A | 170 | 38.65 |
| 11 | 1 | 400 | 74.38 | 153.3 | 53.51 |
| 12 | 2 | 400 | 62.8 | 175.8 | 67.67 |
| 13 | 3 | 400 | 58.6 | 200.8 | 73.96 |
| 14 | 4 | 400 | 55.25 | 228.9 | 79.19 |
| 15 | 5 | 400 | 52.03 | N/D | 81.94 |
| 16 | 5 | 400 | 53.83 | 248.6 | N/D |
| 17 | 6 | 400 | 52.38 | 313.2 | 86.32 |
| 18 | 6.5 | 400 | 52.1 | 347.8 | 88.9 |
| 19 | 7 | 400 | 50.8 | 350.3 | 89.1 |
| 20 | 8 | 400 | 49.4 | 354.7 | 89.4 |

| Sample | C (wt %) | H (wt %) | N (wt %) | S (wt %) | Mesophase Content (vol %) |
|---|---|---|---|---|---|
| 10 | 92.09 | 7.41 | N/D | 0.51 | 0 |
| 11 | 92.65 | 6.50 | 0.25 | 0.54 | 0 |
| 12 | 93.62 | 5.65 | 0.24 | 0.42 | 0 |
| 13 | 93.95 | 5.25 | 0.23 | 0.48 | 0.9 |
| 14 | 94.21 | 5.01 | 0.24 | 0.43 | 12 |
| 15 | 94.24 | 4.85 | 0.26 | 0.45 | 29 |
| 16 | 94.59 | 4.86 | 0.16 | 0.43 | 31 |
| 17 | 94.32 | 4.70 | 0.24 | 0.42 | 39 |
| 18 | 94.41 | 4.30 | 0.32 | 0.39 | 66 |
| 19 | 94.09 | 4.34 | 0.33 | 0.32 | 66 |
| 20 | N/D | N/D | N/D | N/D | 85 |

Table 3 illustrates the results obtained after heat treatment of steam cracker tar 1 (Sample 21). As the heat treatment time increased, the $T_{sp}$, MCR, and mesophase content of the steam cracker tar 1 increased (see Samples 21-28).

TABLE 3

| Sample | Time (h) | T (° C.) | Yield (wt %) | $T_{sp}$ (° C.) | MCR (wt %) |
|---|---|---|---|---|---|
| 21 | 0 | N/A | N/A | N/D | 25.69 |
| 22 | 1 | 400 | 37.2 | 226.8 | 72.57 |
| 23 | 2 | 400 | 34.1 | 307.9 | 83.82 |

TABLE 3-continued

| | | | | | |
|---|---|---|---|---|---|
| 24 | 3 | 400 | 34.4 | >340 | 87.84 |
| 25 | 3 | 400 | 30.9 | N/D | 93.21 |
| 26 | 4 | 400 | 31.6 | >382 | 91.45 |
| 27 | 6 | 400 | 31 | N/D | N/D |
| 28 | 6 | 400 | N/D | >385 | 93.98 |

| Sample | C (wt %) | H (wt %) | N (wt %) | S (wt %) | Mesophase Content (vol %) |
|---|---|---|---|---|---|
| 21 | 89.00 | 6.57 | 0.30 | 4.07 | 0 |
| 22 | 91.23 | 4.83 | 0.33 | 3.61 | 8 |
| 23 | 91.22 | 4.66 | 0.28 | 3.74 | 39 |
| 24 | 92.31 | 4.32 | 0.34 | 3.13 | 58 |
| 25 | 92.48 | 3.99 | 0.27 | 3.08 | 74 |
| 26 | 91.72 | 4.31 | 0.38 | 3.42 | 81 |
| 27 | 92.49 | 3.99 | 0.34 | 2.47 | 87 |
| 28 | 91.92 | 3.92 | 0.43 | 3.02 | 81 |

Table 4 illustrates the results obtained after heat treatment of steam cracker tar 2 (Sample 29). As the heat treatment time increased, the MCR and mesophase content of the steam cracker tar 2 increased (see Samples 29-31).

TABLE 4

| Sample | Time (h) | T (° C.) | Yield (wt %) | $T_{sp}$ (° C.) | MCR (wt %) |
|---|---|---|---|---|---|
| 29 | N/A | N/A | N/A | N/D | 29.5 |
| 30 | 3 | 400 | 38.69 | >330 | 89.29 |
| 31 | 6 | 400 | 35.31 | N/D | 94.43 |

| Sample | C (wt %) | H (wt %) | N (wt %) | S (wt %) | Mesophase Content (vol %) | T10 (° C.) | T50 (° C.) | T90 (° C.) |
|---|---|---|---|---|---|---|---|---|
| 29 | 88.1 | 6.10 | 0.17 | 4.84 | 0 | 296 | 460 | 750 |
| 30 | 91.66 | 4.18 | 0.49 | 2.89 | 68 | N/D | N/D | N/D |
| 31 | 92.40 | 3.88 | 0.38 | 2.87 | 87 | N/D | N/D | N/D |

Table 5 illustrates the results obtained after heat treatment of steam cracker tar 3 (Sample 35).

TABLE 5

| Sample | Time (h) | T (° C.) | Yield (wt %) | $T_{sp}$ (° C.) | MCR (wt %) |
|---|---|---|---|---|---|
| 32 | N/A | N/A | N/A | N/D | 25.9 |
| 33 | 3 | 400 | 33.96 | N/D | 87.67 |
| 34 | 6 | 400 | 31.16 | N/D | 94.57 |

| Sample | C (wt %) | H (wt %) | N (wt %) | S (wt %) | Mesophase Content (vol %) | T10 (° C.) | T50 (° C.) | T90 (° C.) |
|---|---|---|---|---|---|---|---|---|
| 32 | 89 | 6.42 | 0.17 | 5.17 | 0 | 291 | 424 | 700 |
| 33 | 91.80 | 4.19 | 0.28 | 3.63 | 68 | N/D | N/D | N/D |
| 34 | 92.55 | 3.83 | 0.32 | 3.20 | 90 | N/D | N/D | N/D |

Table 6 illustrates the results obtained after heat treatment of hydrotreated steam cracker tar 2 (Sample 35).

TABLE 6

| Sample | Time (h) | T (° C.) | Yield (wt %) | MCR (wt %) | Mesophase Content (vol %) | T10 (° C.) | T50 (° C.) | T83 (° C.) |
|---|---|---|---|---|---|---|---|---|
| 35 | N/A | N/A | N/A | 34.1 | N/D | 464 | 575 | 700 |
| 36 | 1 | 400 | 73 | N/D | N/D | N/D | N/D | N/D |
| 37 | 2 | 400 | 56.6 | 63 | N/D | N/D | N/D | N/D |
| 38 | 3 | 400 | 53.5 | 76.6 | 4 | N/D | N/D | N/D |
| 39 | 4 | 400 | N/D | N/D | N/D | N/D | N/D | N/D |
| 40 | 6 | 400 | 44.1 | N/D | 28 | N/D | N/D | N/D |
| 41 | 6 | 400 | 40.1 | N/D | N/D | N/D | N/D | N/D |
| 42 | 3 | 425 | 40.4 | N/D | 74 | N/D | N/D | N/D |

Table 7 illustrates the results obtained after heat treatment of hydrotreated steam cracker tar 3 (Sample 43).

TABLE 7

| Sample | Time (h) | T (° C.) | Yield (wt %) | MCR (wt %) | Mesophase Content (vol %) | T10 (° C.) | T50 (° C.) | T90 (° C.) |
|---|---|---|---|---|---|---|---|---|
| 43 | N/A | N/A | N/A | 34.4 | N/D | 448 | 541 | 679 |
| 44 | 1 | 400 | 79.1 | N/D | N/D | N/D | N/D | N/D |
| 45 | 2 | 400 | 60.6 | 56.7 | N/D | N/D | N/D | N/D |
| 46 | 3 | 400 | 54.1 | 71.9 | N/D | N/D | N/D | N/D |
| 47 | 6 | 400 | 41.8 | N/D | 42 | N/D | N/D | N/D |
| 48 | 6 | 400 | 40.2 | N/D | N/D | N/D | N/D | N/D |
| 49 | 3 | 425 | 39.2 | N/D | 63 | N/D | N/D | N/D |

Figure 5:
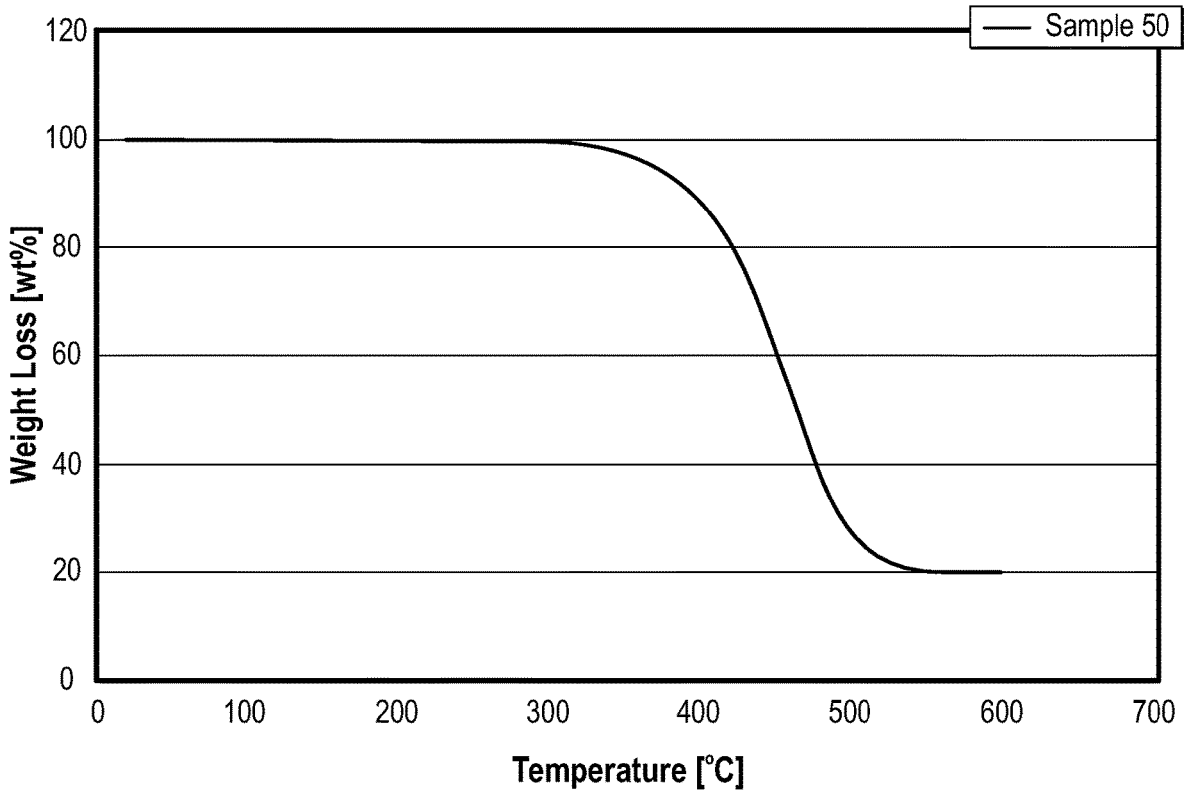
FIG. 5 is a thermal gravimetric analysis (TGA) graph illustrating the weight loss versus the temperature (° C.) of various pitches.

An HDT isotropic pitch (Sample 50) with the elemental composition of 92.3 wt % C, 7.55 wt % H, <0.10 wt % N, 0.551 wt % S, based on the total weight of Sample 50, and having a T10 of 516.11° C. (961° F.), a T50 of 617.22° C. (1143° F.), and T90 of 727.78° C. (1342° F.), was spun into carbon fiber. The MCRT of Sample 50 indicated an MCR of 38.8 wt %, based on the total weight of Sample 50, a $T_{sp}$ of 170° C., and a $T_g$ of 103° C. FIG. 5 is a TGA graph illustrating the weight loss (wt %) versus the temperature (T, ° C.) of Sample 50. As shown in FIG. 5, the TGA of sample 50 revealed a minimal weight loss at around 180° C., suggesting that this may be a suitable spinning temperature due to the presence of very few volatile species.

Spinning HDT isotropic pitch (Sample 50)-based carbon fiber: the carbon fiber was spun at 180° C. with a spinning rate of 20 RPM and a winding speed of 10 m/min and a nozzle diameter of 1 mm on a bench top extruder. Due to the low softening point of Sample 50, stabilization was carried out in an oven by slowly ramping the temperature from 95° C. to 100° C., and further maintaining the temperature at 100° C. for 1 hour. The temperature was then increased to 105° C. and maintained for 1 hour. This process was repeated in 5° C. increments and held at that temperature for 1 hour before moving onto the next temperature. The final stabilized temperature was 220° C.

Heat Treating Steam Cracker Tar:

A steam cracker tar (Sample 51) was pyrolyzed in an autoclave at 250 psig under flowing nitrogen using the conditions outlined in Table 8. The steam cracker tar had 30.5 wt % n-heptane insoluble materials present at room temperature using a 10:1 ratio of n-heptane:filtered product and an elemental analysis of: 89.30 wt % carbon, 6.46 wt % hydrogen, and 0.18 wt % nitrogen. After pyrolysis, the remaining liquid product was filtered at 150° C. and deasphalted with n-heptane at room temperature using a 10:1 ratio of n-heptane:filtered product. The yields and properties of the resulting n-heptane insoluble materials after pyrolysis of a steam cracked tar (Sample 51) are illustrated in Table 8. Sulfur was not independently measured for these samples, but it is anticipated that the majority of the remaining elemental balance would be sulfur.

TABLE 8

| Sample | Time (h) | T (° C.) | Equiv. sec. (875 F.) | NHI (wt %) | MCR (wt %) | $T_{sp}$ (° C.) |
|---|---|---|---|---|---|---|
| 51 | 0 | 0 | 0 | 20 | 56 | 213 |
| 52 | 1 | 400 | 100 | 26 | 75 | 222 |
| 53 | 3 | 410 | 500 | 35 | 80 | 298 |
| 54 | 2 | 425 | 750 | 38 | 81 | 294 |

TABLE 8-continued

| | | | | | | |
|---|---|---|---|---|---|---|
| 55 | 2.7 | 425 | 1,000 | 47 | 85 | 296 |

| Sample | C (wt %) | H (wt %) | N (wt %) | S (wt %) | QI (wt %) |
|---|---|---|---|---|---|
| 51 | 89.80 | 5.80 | 0.24 | ~3.5 | 0 |
| 52 | 87.50 | 5.18 | 0.20 | N/D | 0 |
| 53 | 88.30 | 4.98 | 0.15 | N/D | 0 |
| 54 | 91.80 | 4.77 | 0.16 | N/D | 0 |
| 55 | 92.10 | 4.70 | 0.13 | N/D | 0.2 |

The n-heptane insoluble materials illustrated in Table 8 were then further heat treated in a sand bath using a Swagelok cap and plug mini-bomb reactor for 30 minutes at 400° C. The properties of the resulting heat treated samples are listed in Table 9.

TABLE 9

| Sample | Time (h) | T (° C.) | Equiv. sec. (875 F.) | MCR (wt %) | $T_{sp}$ (° C.) | Mesophase Content (vol %) |
|---|---|---|---|---|---|---|
| 56 | 1 | 400 | 100 | 77 | 263 | 1 |
| 57 | 3 | 410 | 500 | 81 | 249 | 32 |
| 58 | 2 | 425 | 750 | 81 | 247 | 47 |
| 59 | 2.7 | 425 | 1,000 | 83 | 257 | 69 |

| Sample | C (wt %) | H (wt %) | N (wt %) | S (wt %) | QI (wt %) |
|---|---|---|---|---|---|
| 56 | 87.90 | 5.12 | 0.19 | ND | 0.8 |
| 57 | 89.80 | 5.00 | 0.12 | ND | 22.4 |
| 58 | 91.30 | 4.78 | 0.10 | ND | 19.5 |
| 59 | 91.30 | 4.68 | 0.14 | ND | 21.4 |

X-Ray Scattering:

X-ray scattering measurements were performed in the synchrotron beamline, at Advanced Photon source 9-ID, at Argonne National lab which couples Bonse-Hart USAXS (Si 220 crystals) design with pin-hole collimated SAXS and WAXS configuration. For the beamline, a standard configuration with an energy of 21 keV was used. The data represented the q-range covered by SAXS and WAXS detector, taken with an exposure time of 15 and 30 seconds for SAXS/WAXS, respectively. The calibration of all the resultant 2-D SAXS and WAXS patterns were done by using a silver behenate standard (d-spacing of 58.38 Å) and $LaB_6$ standard (a=4.156 Å), respectively. The data was subsequently integrated to obtain 1-D plots of scattered intensity (I) versus the scattering vector, q, where $q=4\pi \sin(\theta)/\lambda$, where $2\theta$ is the scattering angle relative to the incident beam direction. For X-ray data processing, Irena-Nika-USAXS package was used (described by J. Ilaysky and P. R. Jemian in *Journal of Applied Crystallography* (2009), volume 42, pages 347-353; and by J. Ilaysky in *Journal Of Applied Crystallography* (2012), volume 45(2), pages 324-328, which are incorporated herein by reference). Samples were prepared inside kapton tubes of 1.5 mm diameter. Kapton tube background scattering was subtracted from the data to obtain sample scattering alone. Measurements were performed at room temperature. X-ray data (see FIG. 6) indicates characteristic reflections in the wide angle due to π-intermolecular interactions which is clearly evident in mesophase pitch samples (see (002) peak). The X-ray data was deconvoluted into two peak profiles: a Lorenzian peak profile that captured mesophase domains and the isotropic fraction by a Gaussian profile (two isotropic contributions provided a better fit for higher mesophase content samples). The small angle region needs multiple peaks (three Gaussian functions). From the mesophase Lorentz peak width (Δq), stack height ($L_C$) was estimated by the formula;

$$L_C = K\frac{2\pi}{\Delta q};$$

the shape factor K is chosen to be unity. The number of molecules (N) in the stack is estimated by, $N=L_C/d(002)+1$. The interplanar spacing, $$d\,(002) = \frac{2\pi}{q^*};$$

where q* is the peak maximum.

FIG. 6 depicts a room temperature X-ray scattering data of HDT-STC isotropic pitch (Sample 10, at 0 hour), and compared to the X-ray scattering data of its corresponding mesophase samples (Sample 11, at 1 hour; Sample 13, at 3 hours; Sample 14, at 4 hours; Sample 15, at 5 hours) obtained by pyrolysis of Sample 10 at 400° C. during different periods of time (e.g., 0 hour to 5 hours), under $N_2$. The Samples 11, 13, 14, and 15 were subsequently cooled to room temperature. Scattered X-ray intensity was plotted against the scattering vector, q.

Figure 6A:
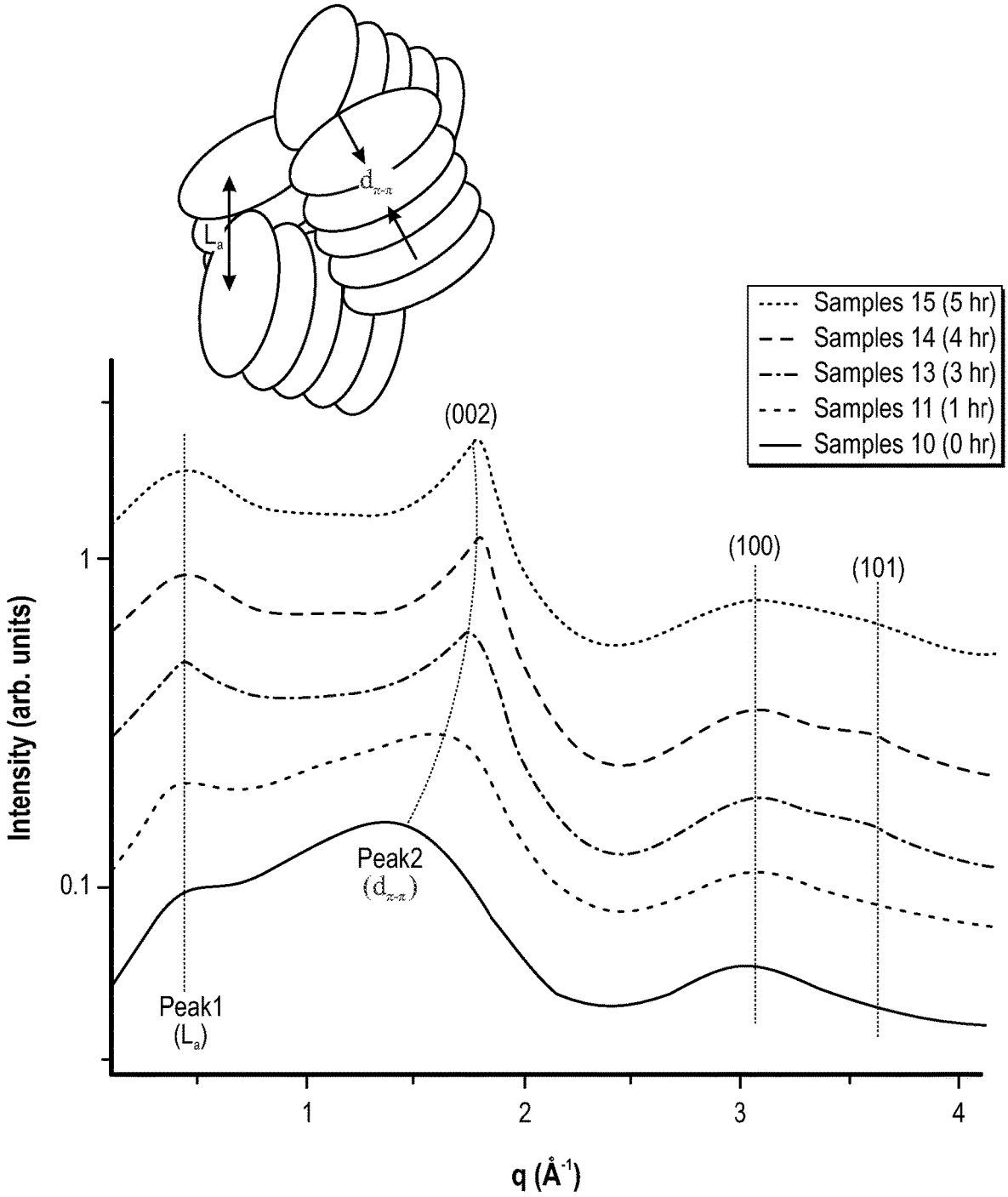
FIG. 6A is a graph illustrating a room temperature X-ray scattering data of an HDT-SCT isotropic pitch and its corresponding anisotropic pitches as function of pyrolysis time.
Figure 6B:
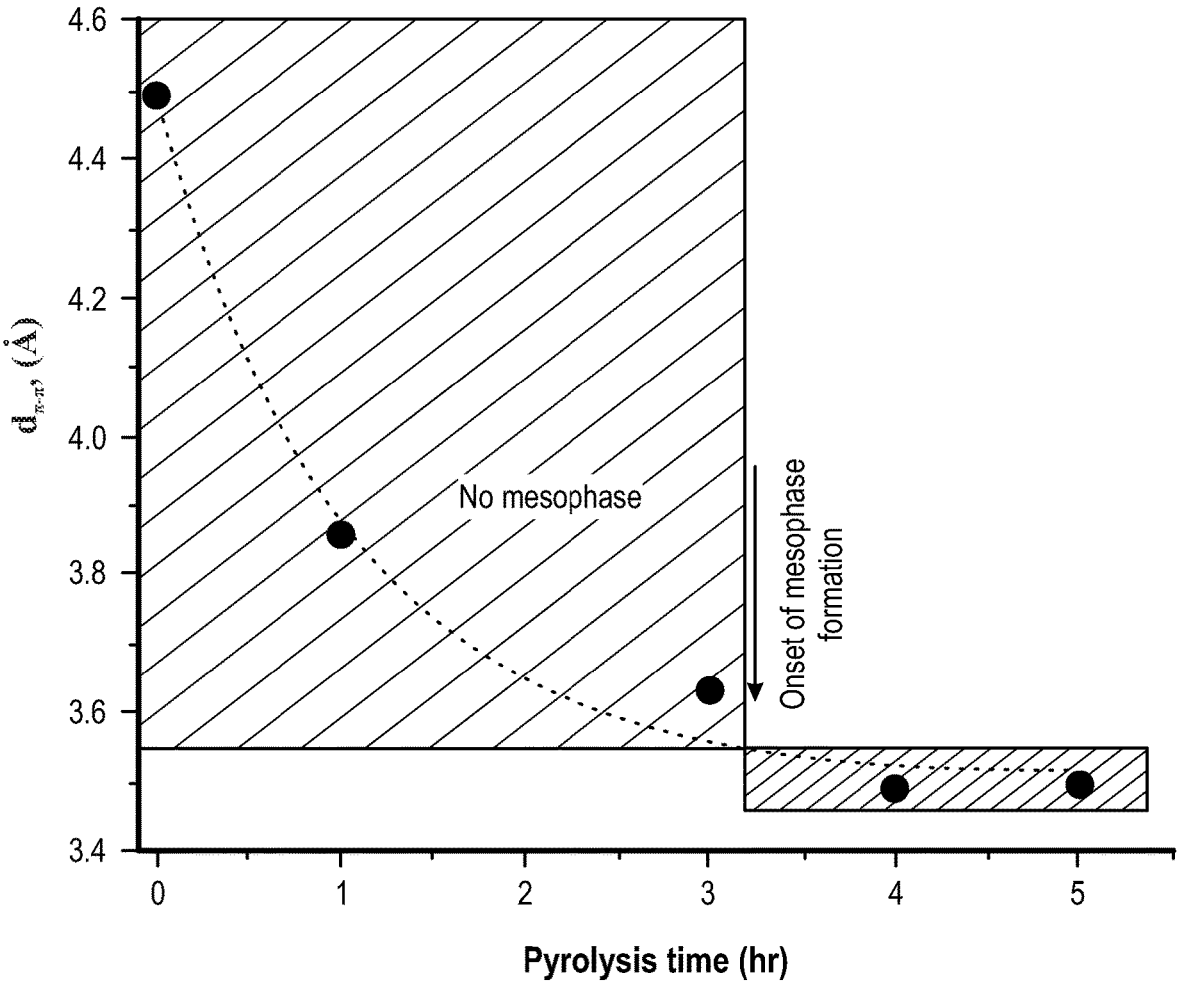
FIG. 6B is a graph illustrating interlayer distance between the molecules $d_{\pi-\pi}$ or d(002) of an HDT-SCT isotropic pitch and its corresponding anisotropic pitches as a function of the pyrolysis time.

FIG. 6A illustrates the scattering data of the HDT-SCT materials as function of pyrolysis time (hr). FIG. 6B illustrates interlayer distance between the molecules (Peak 2, $d_{\pi\text{-}\pi}$, also referred to as d(002)) as a function of the pyrolysis time. The small angle scattering contrast in the HDT-STC isotropic pitch materials originated from condensed aromatic rings (high electron density part) and low electron density side groups (or small aromatic flexible side groups). The scattering peak positions at smaller q determined the intermolecular spacing (i.e., average molecular dimensions). For the isotropic materials, a wide angle scattering peak originated from the liquid-like structure factor. After pyrolysis, improved ordering of planar aromatic molecules through intermolecular interactions (e.g., non-covalent electrostatic interactions such as π-π stacking) led to a shift of the said wide angle peak position to higher q-values (smaller d-spacing), and a decrease in peak width, when compared to Sample 10 starting material. Thus, the scattering contrast (or reflection) in the wide angle (q* of about 1.8 $Å^{-1}$) is attributed to the interplanar spacing of the mesophase domains in the sample. The liquid crystal ordering was also evident in the appearance of the (101) peak indicating π-stacking in the mesophase materials (Samples 11, 13, 14, and 15). The (101) peak begin to appear for Sample 13, for which a fraction of less than 1 vol % mesophase was observed in the PLM data. A stack height ($L_C$) of about 3.6 nm was observed for Sample 13, corresponding to N of about 10 molecules in the stack. Upon further heating for 4 hours, a stack height $L_C$ of about 4.4 nm (N of about 12.5 molecules) was observed. After 5 hours, a stack height $L_C$ of about 4.2 nm (N of about 12 molecules) was observed.

The diffuse low intensity peak of the HDT-STC isotropic pitch (Sample 10) around 0.4 $Å^{-1}$ (i.e., peak 1 position), representing the average spacing between the molecules ($L_a$) in the ordered portion of the pitch material, which is indicative of weak lateral spatial correlations between aromatic molecules (electron density variations). If the side groups were smaller (or low Mw) then the peak 1 positon further provides an estimate of the average size of the aromatic molecules. Larger peak widths also reflect broader size distributions and weaker electron density variations of aromatics (or more random ordering) in the pitch materials. Peak 1 position remained almost steady during the pyrolysis. The aromatic composition in the HDT-STC isotropic pitch produced a small density variation in the pitch materials, thus creating a small signal at 0.4 $Å^{-1}$. It is noteworthy that the peak location (e.g., peak 1 position), or the average size of the pitch samples, does not necessarily capture a consistent change (or increase) in the molecular weight (same peak position can have different molecular weights).

As shown in FIG. 6, the X-ray scattering data of HDT-SCT isotropic pitch (Sample displayed a liquid-like scattering peak corresponding to a scattering vector q* of about 1.4 $Å^{-1}$ (Peak 2), which was due to the electron density correlations of the molecules arising from their Van der Waals separation (liquid-like structural factor). After pyrolysis, the relative intensity of the corresponding peak increased in addition to a decrease in the peak width. Additionally, the peak 2 position at q of about 1.4 $Å^{-1}$ was gradually shifted to higher scattering vector q as a function of time, due to improved aromaticity (molecular growth) and ordering, thus leading to the mesophase formation at later stages (≥3 hours), owing to stronger intermolecular interactions. On the other hand, as the pyrolysis time increased, the heights of the peaks representing the $L_a$ (Å) also increased due to improved spatial correlations, while the corresponding peak locations almost remained steady up to 5 hours of pyrolysis. A constant q-vector for the small angle peak position indicated that the planar aromatic molecules in the mesophase did not show a notable change in average molecular size during the mesophase transformation.

Overall, the X-ray scattering data confirmed, along with the optical microscopy measurements, that the materials upon pyrolysis formed mesophase (discotic nematic), and that the mesophase content increased with pyrolysis time. Furthermore, the average molecular size that constitutes the mesophase domains was steady during the pyrolysis. Thus, the results confirmed the importance of the initial molecular composition, which finally determine (along with the chemistry of the pitch) the final pitch morphology. The stack height of the materials was approximately 4.5 nm, constituting approximately 13 molecules, and consequently providing a pitch with improved liquid crystal ordering, which could enable the production of significantly improved graphitic content, when compared to mesophase pitches produced via traditional processes.

All documents described herein are incorporated by reference herein for purposes of all jurisdictions where such practice is allowed, including any priority documents and/or testing procedures to the extent they are not inconsistent with this text. As is apparent from the foregoing general description and the specific embodiments, while forms of the disclosure have been illustrated and described, various modifications can be made without departing from the spirit and scope of the disclosure. Accordingly, it is not intended that the disclosure be limited thereby. For example, the compositions described herein may be free of any component, or composition not expressly recited or disclosed herein. Any method may lack any step not recited or disclosed herein. Likewise, the term "comprising" is considered synonymous with the term "including." Whenever a method, composition, element or group of elements is preceded with the transitional phrase "comprising," it is understood that we also contemplate the same composition or group of elements with transitional phrases "consisting essentially of," "consisting of," "selected from the group of consisting of," or "is" preceding the recitation of the composition, element, or elements and vice versa.

Whenever a numerical range with a lower limit and an upper limit is disclosed, any number and any included range falling within the range is specifically disclosed, including the lower limit and upper limit. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to one having ordinary skill in the art and having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The embodiments illustratively disclosed herein suitably may be practiced in the absence of any element that is not specifically disclosed herein and/or any optional element disclosed herein.

What is claimed is:

1. A process comprising:

steam cracking of one or more crude oils in a steam cracking zone to produce a first effluent comprising a heavy oil mixture comprising a steam cracker tar, a second effluent comprising a mixture of gaseous products and liquid products, and a third effluent comprising one or more bottoms products;

optionally introducing at least a portion of the first effluent from downstream of the steam cracking zone and/or at least a portion of the second effluent from downstream of the steam cracking zone and/or at least a portion of the third effluent from downstream of the steam cracking zone to one or more pretreating zones to produce a first effluent pretreated product and/or a second effluent pretreated product and/or a third effluent pretreated product;

introducing the first effluent, the first effluent pretreated product, the second effluent, the second effluent pretreated product, the third effluent, the third effluent pretreated product, or any combination thereof, to a reaction zone; and heat treating the first effluent, the first effluent pretreated product, the second effluent, the second effluent pretreated product, the third effluent, the third effluent pretreated product, or any combination thereof, in the reaction zone to a temperature in a range of about 200° C. to about 800° C. to produce a first reaction effluent comprising a pitch product, and a second reaction effluent comprising a mixture of gaseous and liquid products, wherein the pitch product has an MCR in a range of about 40 wt. % to about 95 wt. %, and a softening point Tsp in a range of about 50° C. to about 400° C., wherein the first effluent is sent directly to the reaction zone without introducing to the one or more pretreating zones and the first reaction effluent, the second reaction effluent, or both the first and second reaction effluents are sent to a separation zone after heat treating to produce at least one pitch product and a separated reaction effluent comprised of gaseous and liquid hydrocarbons; and wherein the at least one pitch product following separation has a mesophase content from 5 vol % to 100 vol %, based on a total volume of the at least one pitch product, an MCR in a range of about 40 wt. % to about 95 wt. %, based on a total weight of the at least one pitch product, and a softening point Tsp in a range of about 50° C. to about 400° C.

2. The process of claim 1, wherein the one or more pretreating zones are one or more hydrotreating zones, wherein at least a portion of the first effluent is hydrotreated to produce the first effluent pretreated product, and wherein the first effluent pretreated product is a hydrotreated first effluent product.

3. The process of claim 1, wherein the pitch product has a stack height (LC) of about 2 nm to about 9 nm, as determined by X-ray scattering.

4. The process of claim 3, further comprising:

separating the first reaction effluent and the second reaction effluent in a separation zone to produce at least one pitch product, and a separated reaction effluent comprised of gaseous and liquid hydrocarbons, wherein the at least one pitch product has a mesophase content from 5 vol % to 100 vol %, based on a total volume of the at least one pitch product, an MCR in a range of about 40 wt. % to about 95 wt. %, based on a total weight of the at least one pitch product, and a softening point Tsp in a range of about 50° C. to about 400° C.

5. The process of claim 1, wherein the third effluent comprising one or more bottoms products is sent to a first separation zone to produce at least a first separation product and a second separation product, wherein at least a portion of the first separation product, or at least a portion of the second separation product is sent to a reaction zone to produce a reaction effluent.

6. The process of claim 5, further comprising:

separating the reaction effluent produced from at least a portion of the first separation product, or at least a portion of the second separation product to a second separation zone to produce at least one pitch product, and a separated reaction effluent comprised of gaseous and liquid hydrocarbons, wherein the at least one pitch product has an MCR in the range of about 40 wt. % to about 95 wt. %, based on a total weight of the at least one pitch product, and a softening point Tsp in a range of about 50° C. to about 400° C.

7. The process of claim 1, wherein the first effluent has at least about 70 wt. % of the mixture having a boiling point at atmospheric pressure that is greater than about 200° C., an MCR of about 5 wt. % to about 55 wt. %, a hydrogen content of about 4 wt. % to about 10 wt. %, a sulfur content of about 5 wt. % or less, based on a total weight of the first effluent.

8. The process of claim 1, wherein the pitch product has (1) a quinoline insoluble (QI) content of about 60 wt. % or less, (2) a Tsp of about 100° C. or greater, (3) a Tg of about 70° C. or greater, or (4) a combination thereof.

9. The process of claim 1, wherein the pitch product is sent to one or more heat treating zones to produce a heat treated pitch product having an MCR and a Tsp both greater than the MCR and the Tsp of the pitch product, and wherein the pitch product and/or the heat treated pitch product are suitable for spinning into carbon fiber.

10. The process of claim 9, wherein the heat treated pitch product has one or more of: a mesophase content of about 50 vol % or greater, based on a total volume of the heat treated pitch product; a quinoline insoluble (QI) content of about 10 wt. % or greater, based on the total weight of the heat treated pitch product; and a Tsp of about 200° C. or greater.

11. The process of claim 2, wherein the hydrotreated first effluent product has a T50 in a range of about 225° C. to about 375° C., a hydrogen content of about 7 wt. % to about 12 wt. %, and a sulfur content of from 0 wt. % to about 1 wt. %, based on a total weight of the hydrotreated first effluent product.

12. The process of claim 2, further comprising:

separating the hydrotreated first effluent product downstream of a hydrotreating zone to produce at least a liquid effluent; and recycling the liquid effluent back to an upstream of the hydrotreating zone.

13. The process of claim 11, wherein the third effluent comprises one or more bottoms products and wherein the process further comprising:

separating the one or more bottoms products by deasphaltenation in the presence of a solvent to produce a first portion comprising solvent and soluble compounds, and a second portion comprising solvent and a deasphalted bottom product, wherein the deasphalted bottom product comprises a third pitch product having a softening point Tsp of about 25° C. or greater, a hydrogen content of about 4 wt. % to about 12 wt. %, based on a total weight of the third pitch product, and an MCR of from about 10 wt. % to about 60 wt. %, based on the total weight of the third pitch product, wherein the third pitch product is suitable for spinning into carbon fiber.

14. The process of claim 13, further comprising:

performing a vacuum distillation on at least a portion of the deasphalted bottom product to produce a vacuum gas oil product and a vacuum bottoms product; and producing a fuel oil from at least a portion of the vacuum gas oil product, wherein the fuel oil has a sulfur content of about 1 wt. % or less.

15. The process of claim 1 further comprising:

solvent deasphalting at least a portion of the third effluent in a deasphalting unit to produce a deasphalted oil fraction and a deasphalting residue.

16. The process of claim 13, further comprising:

producing a fiber from the pitch product, the hydrotreated first effluent product, the third pitch product, or any combination thereof, wherein the fiber is an oxidized fiber, carbonized fiber, graphitized fiber, fiber web, oxidized fiber web, carbonized fiber web, or graphitized fiber web.

17. The process of claim 13, further comprising:

mixing the pitch product, the hydrotreated first effluent product, the third pitch product, or any combination thereof, with a needle coke to produce a carbon article capable of forming an electrode for iron and/or aluminum production.

18. The process of claim 13, further comprising:

mixing the pitch product, the hydrotreated first effluent product, the third pitch product, or any combination thereof, with a carbon fiber to produce a carbon article capable of forming carbon-carbon composites.

19. The process of claim 16, wherein the fiber is heat stabilized at a stabilization temperature of less than or equal to Tsp of the pitch product, the hydrotreated first effluent product, or the third pitch product.

20. The process of claim 19, further comprising: graphitizing the carbonized fiber.

21. The process of claim 1, further comprising:

producing high-modulus, high-strength carbon fiber fabric comprising:

spinning one or more pitch products to produce a spun fiber;

stabilizing the spun fiber with an oxidizing gas containing oxygen to produce a stabilized fiber;

weaving a fabric from the stabilized fiber to produce a stabilized fabric;

carbonizing the stabilized fabric to produce a carbonized fabric; and optionally graphitizing the carbonized fabric.

22. A process comprising:

steam cracking of one or more crude oils in a steam cracking zone to produce a first effluent comprising a heavy oil mixture comprising a steam cracker tar, a second effluent comprising a mixture of gaseous products and liquid products, and a third effluent comprising one or more bottoms products, wherein the first effluent is sent directly to a reaction zone for heat treatment to produce a first reaction effluent and/or a second reaction effluent which are/is sent to a separation zone to produce at least one pitch product and a separated reaction effluent comprised of gaseous and liquid hydrocarbons;

introducing the first effluent, the second effluent, the third effluent, or any combination thereof, to the reaction zone; and heat treating the first effluent, the first effluent pretreated product, the second effluent, the second effluent pretreated product, the third effluent, the third effluent pretreated product, or any combination thereof, in the reaction zone to a temperature in a range of about 200° C. to about 800° C. to produce a first reaction effluent comprising a pitch product, and a second reaction effluent comprising a mixture of gaseous and liquid products, wherein the pitch product has an MCR in the range of about 40 wt. % to about 95 wt. %, and a softening point Tsp in a range of about 50° C. to about 400° C.

23. The process of claim 22, further comprising:

introducing at least a portion of the first effluent from downstream of the steam cracking zone and/or at least a portion of the second effluent from downstream of the steam cracking zone and/or at least a portion of the third effluent from downstream of the steam cracking zone to one or more pretreating zones to produce a first effluent pretreated product and/or a second effluent pretreated product and/or the third effluent pretreated product.

* * * * *